US008364047B2

(12) United States Patent
Hadano

(10) Patent No.: US 8,364,047 B2
(45) Date of Patent: Jan. 29, 2013

(54) INFORMATION PROCESSING APPARATUS, INFORMATION PROCESSING METHOD, AND INFORMATION PROCESSING SYSTEM

(75) Inventor: Masahiro Hadano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/451,015

(22) Filed: Apr. 19, 2012

(65) Prior Publication Data

US 2012/0207491 A1 Aug. 16, 2012

Related U.S. Application Data

(63) Continuation of application No. 12/108,384, filed on Apr. 23, 2008, now Pat. No. 8,184,997.

(30) Foreign Application Priority Data

Apr. 24, 2007 (JP) ..... 2007-114331

(51) Int. Cl.
*G03G 15/08* (2006.01)

(52) U.S. Cl. ..... 399/27

(58) Field of Classification Search ..... 399/24, 399/27

See application file for complete search history.

(56) References Cited

U.S. PATENT DOCUMENTS 6,507,723 B2 * 1/2003 Zalewski ..... 399/292
7,158,946 B2 * 1/2007 Sato et al. ..... 705/27.1
7,298,517 B2 * 11/2007 Maeda ..... 358/1.15

FOREIGN PATENT DOCUMENTS

JP 2001305920 A * 11/2001

* cited by examiner

*Primary Examiner* — David Gray
*Assistant Examiner* — Gregory H Curran
(74) *Attorney, Agent, or Firm* — Canon USA, Inc., IP Division

(57) ABSTRACT

An information processing apparatus is configured to communicate with an image forming apparatus. The image forming apparatus includes a toner supply unit having a stationary toner container and a replaceable toner container. The information processing apparatus includes a first receiving unit configured to receive from the image forming apparatus a toner-low notification with respect to the stationary toner container, a second receiving unit configured to receive from the image forming apparatus a replaceability notification with respect to the replaceable toner container, and a management unit configured to manage a stock quantity of the replaceable toner containers based on the toner-low notification received by the first receiving unit and the replaceability notification received by the second receiving unit.

10 Claims, 26 Drawing Sheets

FIG.12

700

From: zaiko@kanri.xxxxx.com
To: koukan@genba.zzzzz.com
SUBJECT: REQUEST FOR REPLACEMENT

TONER CONTAINER HAS BECOME EMPTY.
PLEASE REPLACE THE TONER CONTAINER.

FIG.13

800

From: zaiko@kanri.xxxxx.com
To: koukan@genba.zzzzz.com
SUBJECT: REQUEST FOR REPLACEMENT TONER REMAINING AMOUNT HAS BECOME VERY SMALL.
PLEASE REPLACE TONER CONTAINERS IMMEDIATELY.
NOTE THAT IT IS NECESSARY TO REPLACE N TONER CONTAINERS AT MAXIMUM.

FIG.14

900

From: zaiko@kanri.xxxxx.com
To: haisou001@haisou.yyyyy.com
SUBJECT: REQUEST FOR DISTRIBUTION

PLEASE DISTRIBUTE TONER CONTAINERS AS DESCRIBED BELOW.

| | |
|---|---|
| CUSTOMER NAME: | SHIMOMARUKO BANK |
| DISTRIBUTION DESTINATION: | SHIMOMARUKO TOWER 80TH FLOOR |
| PRINTING APPARATUS ID: | DEV-001-001 |
| CONSUMABLE ID: | SUP-001-001 |
| NUMER OF CONSUMABLES TO BE DISTRIBUTED: | 5 |

FIG.15

1000

TONER CONTAINER REPLACEABLE NOTIFICATION

NOTIFICATION DESTINATION:

SENDING SOURCE INFORMATION:

INDIVIDUAL PRINTING APPARATUS ID:

STATUS ID (TONER CONTAINER REPLACEABLE):

CONSUMABLE ID:

FIG.16

1100

TONER-LOW NOTIFICATION

NOTIFICATION DESTINATION:

SENDING SOURCE INFORMATION:

INDIVIDUAL PRINTING APPARATUS ID:

STATUS ID (TONER LOW):

CONSUMABLE ID:

FIG.17

| 1201 CUSTOMER ID | 1202 CUSTOMER NAME | 1203 CUSTOMER ACCESS INFORMATION | 1204 REPLACEMENT CONTRACTOR CONTACT INFORMATION | 1205 REPLACEMENT NOTIFICATION | 1206 NUMBER OF PRINTING APPARATUS | 1207 PRINTING APPARATUS ID1 | 1208 INDIVIDUAL PRINTING APPARATUS ID1 | ... | 1207 PRINTING APPARATUS IDn | 1208 INDIVIDUAL PRINTING APPARATUS IDn |
|---|---|---|---|---|---|---|---|---|---|---|
| user001 | SHIMOMARUKO BANK | SHIMOMARUKO TOWER 80TH FLOOR | koukan@genba.zzzzz.com | ON | n | DEV-001-001 | aabbccddeeff | ... | DEV-AAA-A01 | cccddeeee |
| user002 | MARUKO YUENCHI PARK | MARUKO YUENCHI PARK BUILDING | koukan@koukan.aaabbb.com | ON | 1 | DEV-AAA-A01 | aaaaaabbbbbb | — | — | — |

FIG.18

| 1301 NOTIFICATION TYPE ID | 1302 SUBJECT | 1303 TEXT |
|---|---|---|
| msg001 | REQUEST FOR REPLACEMENT | TONER CONTAINER HAS BECOME EMPTY. PLEASE REPLACE THE TONER CONTAINER. |
| msg002 | REQUEST FOR REPLACEMENT | TONER REMAINING AMOUNT HAS BECOME VERY SMALL. PLEASE REPLACE THE TONER CONTAINER IMMEDIATELY. NOTE THAT IT IS NECESSARY TO REPLACE N TONER CONTAINERS AT MAXIMUM. |
| msg003 | REQUEST FOR DISTRIBUTION | PLEASE DISTRIBUTE TONER CONTAINERS AS DESCRIBED BELOW. |

FIG.19

| 1401 STATUS ID | 1402 STATUS NAME | 1403 NOTIFICATION TYPE ID |
|---|---|---|
| st00001 | TONER CONTAINER REPLACEABLE | msg001 |
| st00002 | TONER LOW | msg002 |
| • | • | • |

FIG.20

| 1501 PRINTING APPARATUS ID | 1502 PRINTING APPARATUS NAME |
|---|---|
| DEV-001-001 | MFP A |
| DEV-AAA-A01 | MFP B |

FIG.21

| 1601 CONSUMABLE ID | 1602 CONSUMABLE NAME | 1603 USABLE IN PRINTING APPARATUS... |
|---|---|---|
| SUP-001-001 | TONER 001 | DEV-001-001 |
| SUP-AAA-A01 | TONER AAA | DEV-AAA-A01 |

FIG.22

| 1701 CUSTOMER ID | 1702 STOCK QUANTITY | 1703 MAXIMUM STOCK QUANTITY | 1704 NOTIFICATION THRESHOLD VALUE | 1705 N VALUE | 1706 M VALUE | 1707 CONSUMABLE ID | 1708 STOCK STORAGE LOCATION |
|---|---|---|---|---|---|---|---|
| user001 | 7 | 10 | 5 | 3 | 0 | SUP-001-001 | GENERAL AFFAIRS DEPARTMENT OA CORNER |
| user002 | 9 | 10 | 3 | 2 | 1 | SUP-AAA-A01 | WAREHOUSE #1 |

FIG.23

| 1801 DISTRIBUTOR ID | 1802 DISTRIBUTOR NAME | 1803 DISTRIBUTOR CONTACT INFORMATION | 1804 NUMBER OF CUSTOMERS | 1805 CUSTOMER ID1 | ... | CUSTOMER IDn |
|---|---|---|---|---|---|---|
| del00001 | MARUKO HAISOU CO., LTD. | haisou001@haisou.yyyyyy.com | n | user001 | ... | user00n |

INFORMATION PROCESSING APPARATUS, INFORMATION PROCESSING METHOD, AND INFORMATION PROCESSING SYSTEM

CROSS-REFERENCE TO RELATED APPLICATIONS

This application is a continuation of U.S. patent application Ser. No. 12/108,384 filed Apr. 23, 2008, which claims priority to Japanese Patent Application No. 2007-114331 filed Apr. 24, 2007, each of which is hereby incorporated by reference herein in its entirety.

BACKGROUND OF THE INVENTION

1. Field of the Invention

The present invention relates to an information processing apparatus and an information processing method configured to manage consumables used in an image forming apparatus, such as a printer, a multifunction peripheral (MFP), and a copying machine.

2. Description of the Related Art

A conventional method for managing a consumable in a printing apparatus acquires from a printing apparatus toner-low information about a toner cartridge, predicts a time of toner exhaustion, and notifies a customer (a user of the printing apparatus) regarding a time to replenish the printing apparatus with a new toner cartridge or collect the consumed toner cartridge (see Japanese Patent Application Laid-Open No. 2001-305920).

Such a conventional method is not intended to replenish or collect a toner cartridge after toner exhaustion is detected but predicts toner exhaustion based on previously acquired toner-low information. Furthermore, such a conventional method sends the toner-low information to a service contractor who distributes a new toner and to an administrator of the printing apparatus. Thus, such a conventional method can reduce the possibility of shortage of a toner cartridge in a customer side.

The above method discussed by Japanese Patent Application Laid-Open No. 2001-305920 determines whether it is necessary to replenish or collect a toner cartridge based only on the toner-low information about the currently used toner cartridge. Furthermore, according to the above conventional method, the number of toner cartridge to be replaced is one.

However, in the case of a toner supply unit having a shape different from the shape of a conventional toner supply unit, if more than one toner container needs to be replaced according to a current toner remaining amount, the above conventional method may not always appropriately issue a notification to a replacement contractor.

More specifically, in managing the stock quantity of toner containers, if such toner exhaustion or toner-low status with respect to a plurality of toner containers is to be indicated by one toner-low notification, a new more effective method is necessary and desired that manages the toner container stock quantity to be adjusted based on one toner-low notification. Furthermore, there may be a case where the number of consumables (toner containers) in a stock may become very small in a shorter time than expected. Thus, it is necessary and desired to provide a method for requesting a replacement contractor (distributor) to replenish or distribute a consumable at an appropriate timing.

SUMMARY OF THE INVENTION

The present invention is directed to an information processing apparatus configured to appropriately manage the stock quantity of toner containers if the shape of a toner supply unit is different from the shape of a conventional toner supply unit.

According to an aspect of the present invention, an information processing apparatus is configured to communicate with an image forming apparatus. The image forming apparatus includes a toner supply unit having a stationary toner container and a replaceable toner container. The information processing apparatus includes a first receiving unit configured to receive from the image forming apparatus a toner-low notification with respect to the stationary toner container, a second receiving unit configured to receive from the image forming apparatus a replaceability notification with respect to the replaceable toner container, and a management unit configured to manage a stock quantity of the replaceable toner containers based on the toner-low notification received by the first receiving unit and the replaceability notification received by the second receiving unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

FIG. 12 illustrates an example of a replacement request notification, which is sent to a replacement contractor who replaces the toner container when the management apparatus receives a notification that toner container is replaceable, according to the first exemplary embodiment of the present invention.

FIG. 13 illustrates an example of a replacement request notification, which is sent to a replacement contractor who replaces the toner container when the management apparatus receives a toner-low notification with respect to the toner hopper, according to the first exemplary embodiment of the present invention.

FIG. 14 illustrates an example of a distribution request notification, which is processed and sent by a stock management unit to a distributor who distributes the toner container when the quantity of the stocks in a stock storage location has reached a distribution threshold value, according to the first exemplary embodiment of the present invention.

FIG. 15 illustrates an example of a data content of a notification that toner container is replaceable, sent from the printing apparatus to the management apparatus according to the first exemplary embodiment of the present invention.

FIG. 16 illustrates an example of a data content of a toner-low notification with respect to the toner hopper sent from the printing apparatus to the management apparatus according to the first exemplary embodiment of the present invention.

FIG. 17 illustrates an example of a customer information database managed by the management apparatus according to the first exemplary embodiment of the present invention.

FIG. 18 illustrates an example of a notification information database managed by the management apparatus according to the first exemplary embodiment of the present invention.

FIG. 19 illustrates an example of a status information database managed by the management apparatus according to the first exemplary embodiment of the present invention.

FIG. 20 illustrates an example of a printing apparatus database managed by the management apparatus according to the first exemplary embodiment of the present invention.

FIG. 21 illustrates an example of a consumable database managed by the management apparatus according to the first exemplary embodiment of the present invention.

FIG. 22 illustrates an example of a stock management database managed by the management apparatus according to the first exemplary embodiment of the present invention.

FIG. 23 illustrates an example of a distributor database managed by the management apparatus according to the first exemplary embodiment of the present invention.

DETAILED DESCRIPTION OF THE EMBODIMENTS

Various exemplary embodiments, features, and aspects of the present invention are described in detail below with reference to the drawings. The relative arrangement of the components, the numerical expressions, and numerical values set forth in these embodiments are not intended to limit the scope of the present invention.

First Exemplary Embodiment

Figure 1:
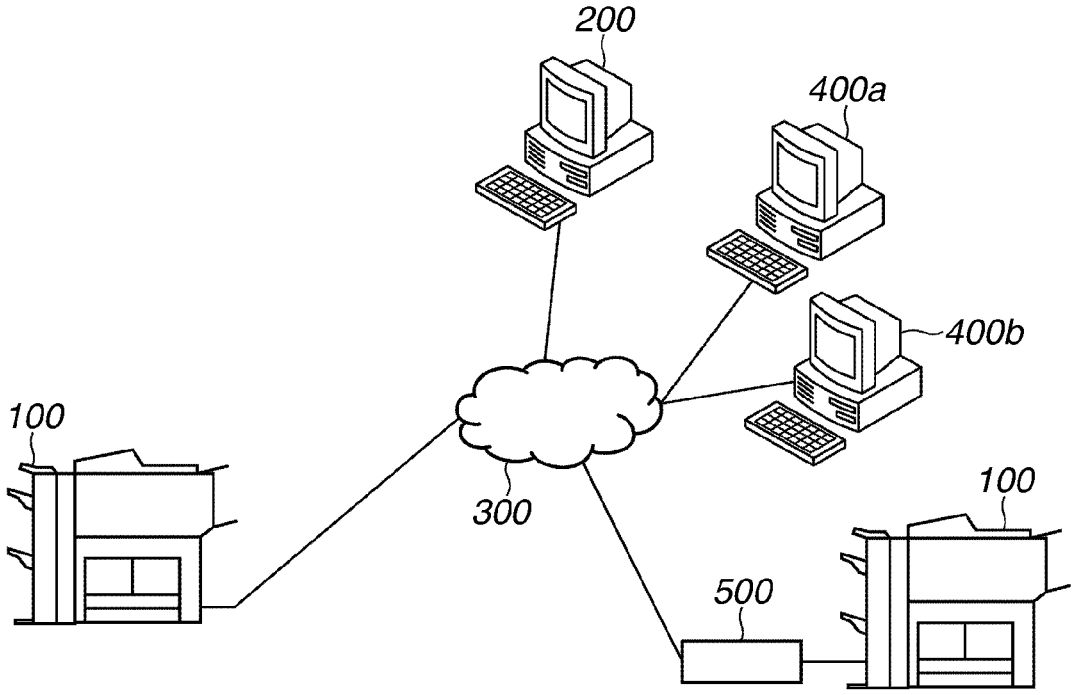
FIG. 1 illustrates an example of a configuration of the entire information processing system according to a first exemplary embodiment of the present invention.

A first exemplary embodiment of the present invention is described below. FIG. 1 illustrates an example of a configuration of the entire information processing system according to the first embodiment of the present invention.

Referring to FIG. 1, a printing apparatus 100 (as shown in the lower left portion of FIG. 1) and a management apparatus 200 are in communication with each other via a network 300. Optionally, as shown in the lower right portion of FIG. 1, a communication control apparatus 500 can be connected to the printing apparatus 100 and the management apparatus 200 via the network 300 to control a communication between the printing apparatus 100 and the management apparatus 200. Furthermore, a personal computer (PC) for replacement contractor 400*a* and a PC for distributor 400*b* are connected via the network 300.

The printing apparatus 100 can be, for example, an MFP (including functions such as a print function, a scan function, a SEND function, and a BOX function) or a copying machine. The printing apparatus 100 consumes a toner and an ink. A consumable such as a toner and an ink can be replaced simply by changing a container thereof. Generally, in an environment where the printing apparatus 100 is utilized, there is a stock storage location.

When it is necessary to replenish a consumable, the container of the consumable currently mounted in the printing apparatus 100 is replaced with a new consumable stored in the stock storage location.

The printing apparatus 100 can detect an operation status thereof and notify the detected operation status of the printing apparatus 100 to the management apparatus 200. The operation status of the printing apparatus 100 includes a status of the consumable used in the printing apparatus 100.

The management apparatus 200 remotely monitors the operation status of the printing apparatus 100. The remote monitoring of the operation status of the printing apparatus 100 includes a management of the consumable.

The management apparatus 200 receives status information about a consumable from the printing apparatus 100. If it is determined that it is necessary to replace the consumable, then the management apparatus 200 sends a replacement request to a consumable replacement contractor. Furthermore, the management apparatus 200 manages the stock quantity of consumables stored in the stock storage location for each printing apparatus 100.

If the consumable status information sent from the printing apparatus 100 indicates that it is necessary to replace a consumable, then the management apparatus 200 manages the number of the stored consumable by decrementing the stock quantity of the consumables. If the stock quantity of the consumables stored in the stock storage location becomes smaller than a predetermined value, then the management apparatus 200 sends a consumable distribution request notification to a distributor.

Furthermore, the management apparatus 200 generates a web screen that displays status information about the stored consumable. The web screen provides a stock management interface.

The network 300 can be a communication line such as the Internet or a local area network (LAN).

The PC for replacement contractor 400*a* is a terminal apparatus, which is a destination of a consumable replacement request notification sent from the management apparatus 200. The PC for distributor 400*b* is a terminal apparatus, which is a destination of a consumable distribution request notification sent from the management apparatus 200.

The communication control apparatus 500 can include a function for acquiring information about the operation status of the printing apparatus 100.

The present invention can be applied to a case where a plurality of printing apparatuses 100 monitored by the management apparatus 200 exists in the information processing system. Furthermore, functions of the management apparatus 200, the PC for replacement contractor 400*a*, and the PC for distributor 400*b* can be installed and implemented in one or two PCs.

Moreover, the monitoring and notification by the management apparatus 200 of the operation status of the printing apparatus 100 can also be performed by the printing apparatus 100 itself. Alternatively, an information processing apparatus such as the communication control apparatus 500 which is associated with the printing apparatus 100 can perform such monitoring and notification.

Figure 2:
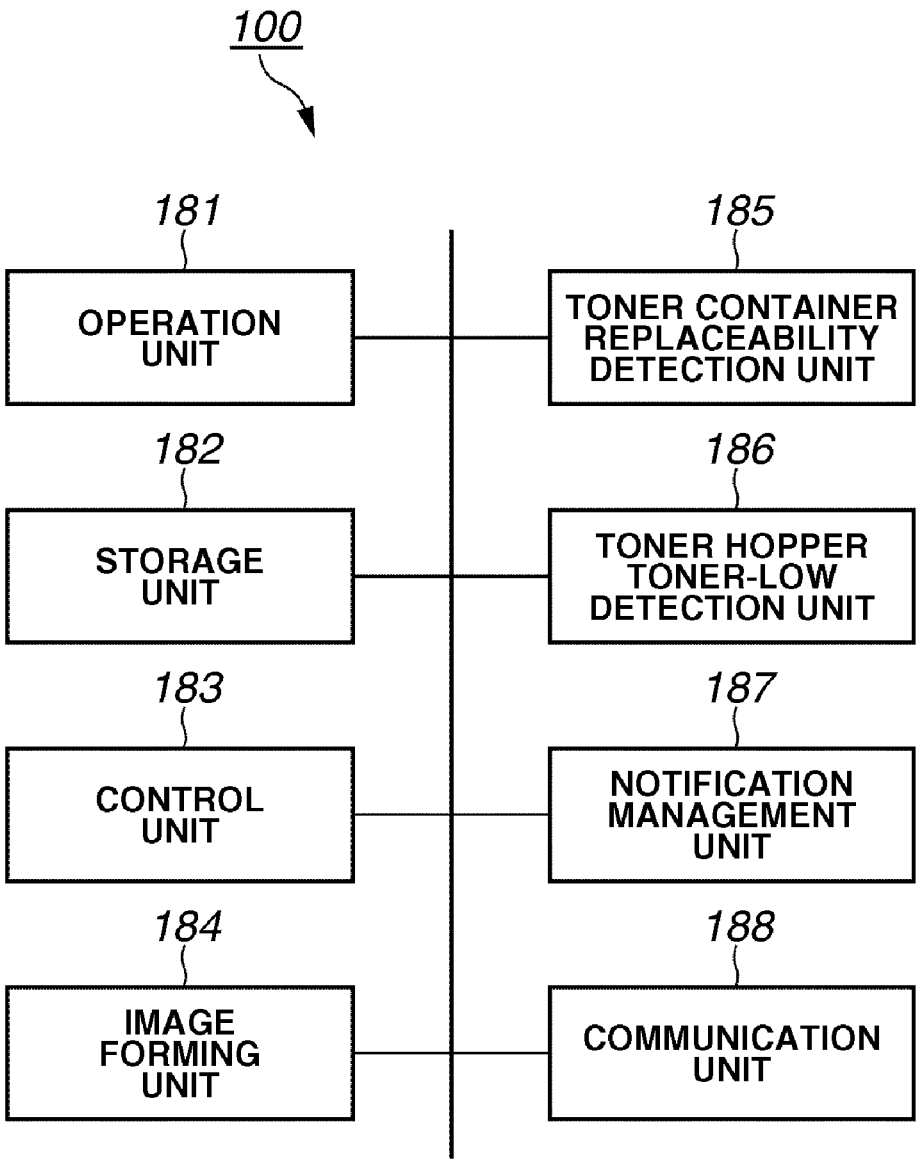
FIG. 2 illustrates an example of a configuration of a printing apparatus according to the first exemplary embodiment of the present invention.

FIG. 2 illustrates an example of a configuration of the printing apparatus 100 according to the present exemplary embodiment.

Referring to FIG. 2, the printing apparatus 100 includes an operation unit 181, a storage unit 182, a control unit 183, an image forming unit 184, a toner container replaceability detection unit 185, a toner hopper toner-low detection unit 186, a notification management unit 187, and a communication unit 188.

The operation unit 181 manages an operating instruction provided by a user to the printing apparatus 100, such as a print instruction. The operation unit 181 receives an operating instruction from the user primarily via a screen such as a touch panel and a button provided in the printing apparatus 100.

The storage unit 182 stores operation history information, printing apparatus management information, status information, communication information, and electronic data.

The operation history information includes a log about an operation status of the printing apparatus 100 and information about the number of prints. The printing apparatus management information includes a printing apparatus identification (ID) of the printing apparatus 100 and a consumable ID.

The status information describes an operation status of the printing apparatus 100, including information about a status of a consumable. More specifically, the status information includes information about an operation status of the printing apparatus 100 itself, various error information, as well as information about a remaining amount of a consumable such as a toner.

The communication information includes information about a notification destination and a sending source apparatus, which can be used in notifying information about the printing apparatus 100 to the management apparatus 200. The electronic data can be used in printing and includes data to be transmitted via a facsimile or an e-mail, and temporarily stored image data.

The control unit 183, in response to a print instruction by the user via the operation unit 181, starts print processing and manages a print job. Furthermore, the control unit 183 manages counter information and status information about the printing apparatus 100 and provides instruction to notify the management apparatus 200 about the counter information and the status information.

The image forming unit 184 generates image data used in printing. Accordingly, the image forming unit 184 includes a toner supply unit. The toner supply unit according to the present exemplary embodiment includes a replaceable toner container, a stationary toner hopper, and a development device. The components of the toner supply unit are described in detail below.

The toner container replaceability detection unit 185 detects whether an amount of toner in a replaceable toner container has become small. If it is determined that an amount of toner in a replaceable toner container has become small, then the toner container replaceability detection unit 185 notifies the result of the detection to the control unit 183. More specifically, the toner container replaceability detection unit 185 monitors whether an amount of toner remaining in a toner container has become smaller than a predetermined amount.

The toner hopper toner-low detection unit 186 monitors whether an amount of toner remaining in a toner hopper has become smaller than a predetermined amount. If it is determined that an amount of toner remaining in a toner hopper has become smaller than a predetermined amount, then the toner hopper toner-low detection unit 186 notifies the result of the detection to the control unit 183. If it is determined by the toner container replaceability detection unit 185 or the toner hopper toner-low detection unit 186 that a toner remaining amount has become smaller than a predetermined amount, then the control unit 183 instructs the notification management unit 187 to perform notification processing.

The notification management unit 187 generates data to be sent to the management apparatus 200, according to a result of the detection by the toner container replaceability detection unit 185 and the toner hopper toner-low detection unit 186. In particular, the notification management unit 187 generates toner container replaceable notification data based on information detected by the toner container replaceability detection unit 185. The notification management unit 187 also generates toner-low notification data based on information detected by the toner hopper toner-low detection unit 186.

The communication unit 188 sends the notification data to the management apparatus 200 as consumable status information. Here, the communication unit 188 sends the notification data via an e-mail or via the Internet via HyperText Transport Protocol (HTTP) protocol. Furthermore, the communication unit 188 can display a content of the notification data on a screen of the management apparatus 200 to prompt an administrator of the system to request the replacement of the toner content.

Figure 3:
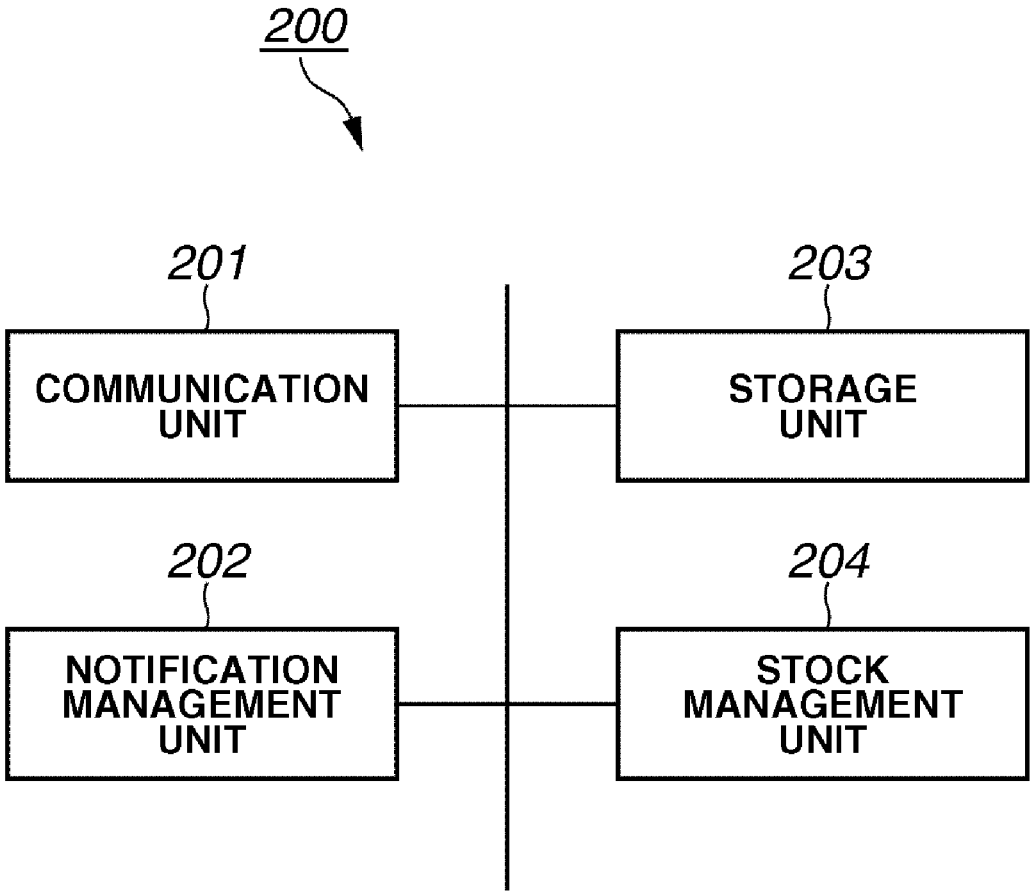
FIG. 3 illustrates an example of a configuration of a management apparatus according to the first exemplary embodiment of the present invention.

FIG. 3 illustrates an example of a configuration of the management apparatus 200 according to the present exemplary embodiment.

Referring to FIG. 3, the management apparatus 200 includes a communication unit 201, a notification management unit 202, a storage unit 203, and a stock management unit 204. The communication unit 201 receives a notification from an external apparatus such as the printing apparatus 100 and sends a notification to the PC for replacement contractor 400*a* or the PC for distributor 400*b*.

The notification management unit 202 performs analysis processing or storage processing on the notification data that the communication unit 201 has received. The analysis or storage processing is responsive to the content of the received notification data. When it is necessary to perform notification processing according to the result of the analysis processing, the notification management unit 202 generates notification data and sends the generated notification data to an appropriate contact.

The storage unit 203 manages sent/received data and an analysis result. More specifically, the storage unit 203 manages customer information, notification information, status information, information about the printing apparatus 100, information about a consumable, stock management information, and distributor information.

The stock management unit 204 adjusts a stock quantity in a stock storage location on a customer side. The adjustment is based on the received consumable information about the printing apparatus 100. In the present exemplary embodiment, the consumable information includes a toner container replaceable notification and a toner-low notification. When the management apparatus 200 receives a toner container replaceable notification or a toner-low notification, it can be considered that the toner container loaded in the printing apparatus 100 is to be replaced. The stock management unit 204 calculates a number of toner containers to be replaced and derives the quantity of the containers stocked in the stock storage location.

Figure 27:
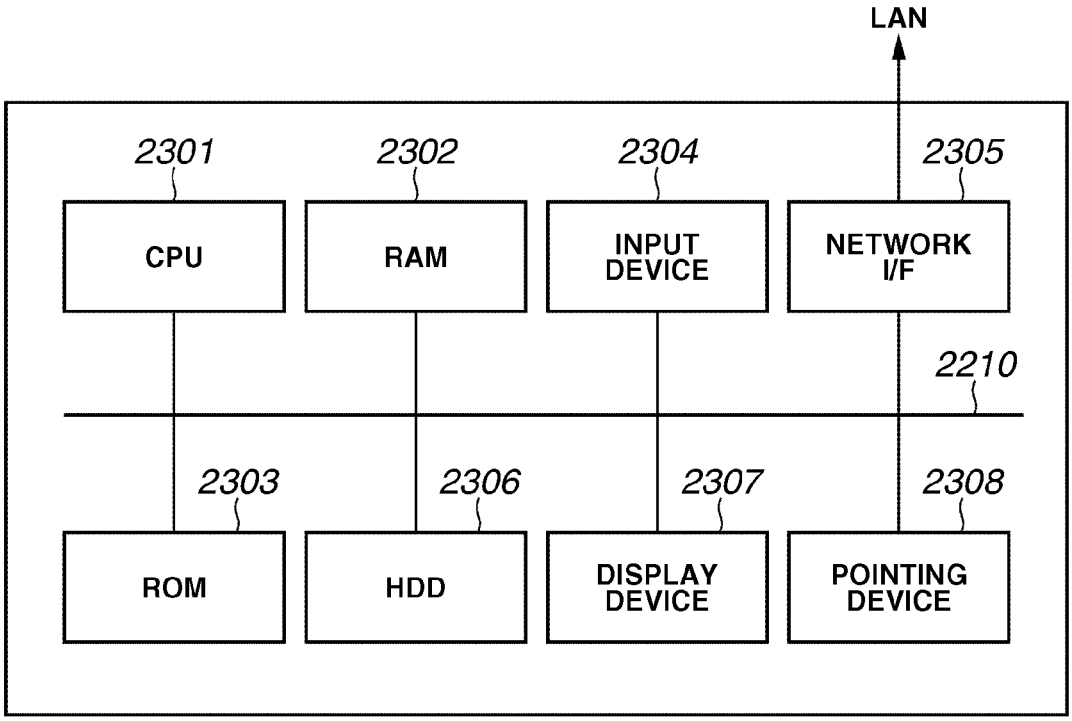
FIG. 27 illustrates an example of a hardware configuration of the information processing apparatus according to the first exemplary embodiment of the present invention.

FIG. 27 illustrates an example of a hardware configuration of the information processing apparatus, such as the management apparatus 200, the communication control apparatus 500, the PC for replacement contractor 400*a*, and the PC for distributor 400*b*, according to the present exemplary embodiment.

Referring to FIG. 27, a central processing unit (CPU) 2301, a random access memory (RAM) 2302, a read-only memory (ROM) 2303, an input device 2304 such as a keyboard, a network interface (I/F) 2305, and a hard disk drive (HDD) 2306, a display device 2307 such as a cathode ray tube (CRT), and a pointing device 2308 such as a mouse are in communication with one another via a system bus 2210.

The ROM 2303 or the HDD 2306 stores a control program. The control program may be written into the ROM 2303 or HDD 2306 prior to use. The CPU 2301 implements a function as a computer by loading the control program from the ROM 2303 or the HDD 2306 on the RAM 2302 and executing the loaded control program as needed.

Furthermore, the CPU 2301 displays various information on the display device 2307 and receives an instruction given by a user via the input device 2304 and the pointing device 2308. Moreover, the CPU 2301 performs data communication via the network I/F 2305 with another apparatus connected to the management apparatus 200 via the network, such as LAN.

Figure 4:
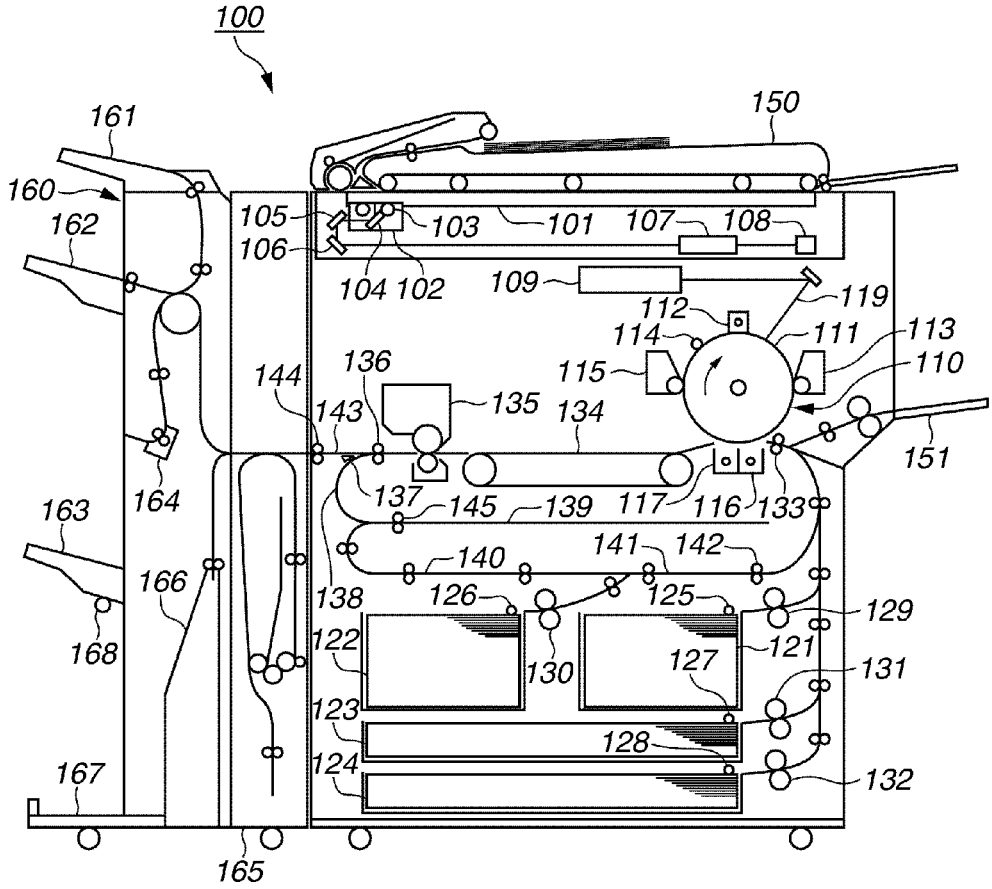
FIG. 4 is a cross-section view illustrating an example of a configuration of the printing apparatus according to the first exemplary embodiment of the present invention.

FIG. 4 is a cross-sectional view that illustrates an example of structure of the printing apparatus 100 according to the present exemplary embodiment. Referring to FIG. 4, the printing apparatus 100 includes an auto document feeder (ADF) 150 and a reciprocating scanner 102. The scanner 102 includes a document illumination lamp 103 and a scanning mirror 104.

The ADF 150 conveys documents sheet by sheet, starting from a last page, onto a platen glass 101. After completely reading the document, the ADF 150 discharges the document. The document conveyed onto the platen glass 101 is scanned by the reciprocating scanner 102, which is driven by a motor (not illustrated). The light reflected from the document transmits through a lens 107 via scanning mirrors 104 through 106, and then forms an image on a charge-coupled device (CCD) sensor in an image sensor unit 108. The image sensor unit 108 converts the image on the CCD into an electrical signal.

An exposure control unit 109 includes a laser unit and a polygon scanner. The exposure control unit 109 irradiates a photosensitive drum 111 with a laser beam 119 modulated into an image signal. In particular, the electrical signal provided by the image sensor unit 108 is subjected to specific image processing to provide a processed electrical signal that is used to modulate the laser beam 119.

A primary charger 112, a toner supply unit 113, a transfer charger 116, a pre-exposure lamp 114, and a cleaning device 115 are provided around the photosensitive drum 111.

In an image forming unit 110, the photosensitive drum 111 is driven and rotated by a motor (not illustrated) in a direction indicated by an arrow in FIG. 4. The photosensitive drum 111 is charged to a predetermined level of potential by the primary charger 112. Then, the exposure control unit 109 irradiates the photosensitive drum 111 with the laser beam 119 to form an electrostatic latent image on the photosensitive drum 111. The electrostatic latent image thus formed on the photosensitive drum 111 is then developed by a development device in the toner supply unit 113 and visualized as a toner image.

A transfer paper fed from a right cassette deck 121, a left cassette deck 122, an upper cassette 123, or a lower cassette 124 to pickup rollers 125 through 128 is then conveyed onto a transfer belt 134 by paper feed rollers 129 through 132 and a registration roller 133. In this paper feeding process, the visualized toner image is transferred onto the transfer paper by the transfer charger 116. Furthermore, the printing apparatus 100 includes a multi manual feed tray 151, which can be used for feeding a transfer paper.

After the toner image has been transferred onto the transfer paper, the cleaning device 115 cleans off a residual toner from the surface of the photosensitive drum 111 and the pre-exposure lamp 114 eliminates a residual charge therefrom. The transfer paper having the toner image is then separated from the photosensitive drum 111 by a separation charger 117. Then, the separated transfer paper having the toner image is conveyed to a fixing device 135 by the transfer belt 134. The fixing device 135 applies pressure and heat to the transfer paper to fix the toner image. Then, the transfer paper having the fixed toner image is discharged by a discharge roller 136 to an outside of the printing apparatus 100.

A paper discharge flapper 137 flaps to switch between a paper conveyance path 138 and a paper discharge path 143. A lower conveyance path 140 guides the transfer paper discharged by the discharge roller 136 into a paper re-feed path 141 by reversing the surface of the transfer paper via a reverse path 139. The lower conveyance path 140 guides the transfer paper fed from the left cassette deck 122 by the paper feed roller 130 into the paper re-feed path 141.

A paper re-feed roller 142 re-feeds the transfer paper into the image forming unit 110. A discharge roller 144 is disposed in the vicinity of the paper discharge flapper 137. The discharge roller 144 discharges the transfer paper whose path has been switched to the paper discharge path 143 by the paper discharge flapper 137 to an outside of the printing apparatus 100.

When the printing apparatus 100 is in a two-sided recording mode (two-sided copy mode), the paper discharge flapper 137 lifts upward and the printed transfer paper is guided into the paper re-feed path 141 via the paper conveyance path 138, the reverse path 139, and the lower conveyance path 140. At this time, driven by a reverse roller 145, a trailing edge of the transfer paper has completely passed the paper conveyance path 138. Then, the transfer paper is conveyed into the reverse path 139 and is fed to a position at which the transfer paper is pinched by the reverse roller 145. Then, the reverse roller 145 rotates in a reverse direction to feed the transfer paper into the lower conveyance path 140.

In the case of discharging the transfer paper from the printing apparatus 100 in a reversed state, the paper discharge flapper 137 lifts upward. Then, the transfer paper is conveyed into the reverse path 139 by the reverse roller 145, to a position at which the trailing edge of the transfer paper stays inside the paper conveyance path 138. Then, the reverse roller 145 rotates in a reverse direction to reverse the surface of the transfer paper and discharge the transfer paper to the discharge roller 144.

A paper discharge processing apparatus 160 jogs and staples the transfer papers that have been discharged from the printing apparatus 100. The paper discharge processing apparatus 160 stacks and jogs the transfer papers, which have been discharged from the printing apparatus 100 sheet by sheet, on a paper stack processing tray 164. When image forming processing for one copy has been completed, the paper discharge processing apparatus 160 staples a bundle of transfer papers and discharges the stapled transfer paper bundle onto a paper discharge tray 162 or a paper discharge tray 163.

The paper discharge tray 163 is elevated under control of a motor (not illustrated). The paper discharge tray 163 elevates to a position of the paper stack processing tray 164 before an image forming operation starts. As the transfer papers that have been discharged are being stacked on the paper discharge tray 163, the paper discharge tray 163 moves so that a height of a top sheet of the transfer papers stacked thereon comes level with a position of the paper stack processing tray 164.

A tray lower limit sensor 168 detects a lower positional limit of the paper discharge tray 163. The tray lower limit sensor 168 detects stacking of transfer papers on the paper discharge tray 163 exceeding a predetermined number of transfer papers.

A paper tray 161 is used for stacking separator papers to be inserted between the discharged transfer papers. A z-folding machine 165 z-folds the discharged transfer paper. A bookbinding machine 166 center-folds and staples one copy of the discharged transfer papers and binds the z-folded and stapled transfer papers into a book. The bound sheet bundle is discharged onto a discharge tray 167.

In addition, various sensors (not illustrated) are provided at appropriate positions of the information processing apparatus according to the present exemplary embodiment, as illustrated in the cross-section in FIG. 4. The sensors detect various phenomena and statuses such as toner exhaustion, a jamming of document, a remaining amount of transfer paper, a jamming of transfer paper, a remaining amount of consumables related to development, and a dead document illumination lamp 103, and various other mechanical failures.

Figure 5:
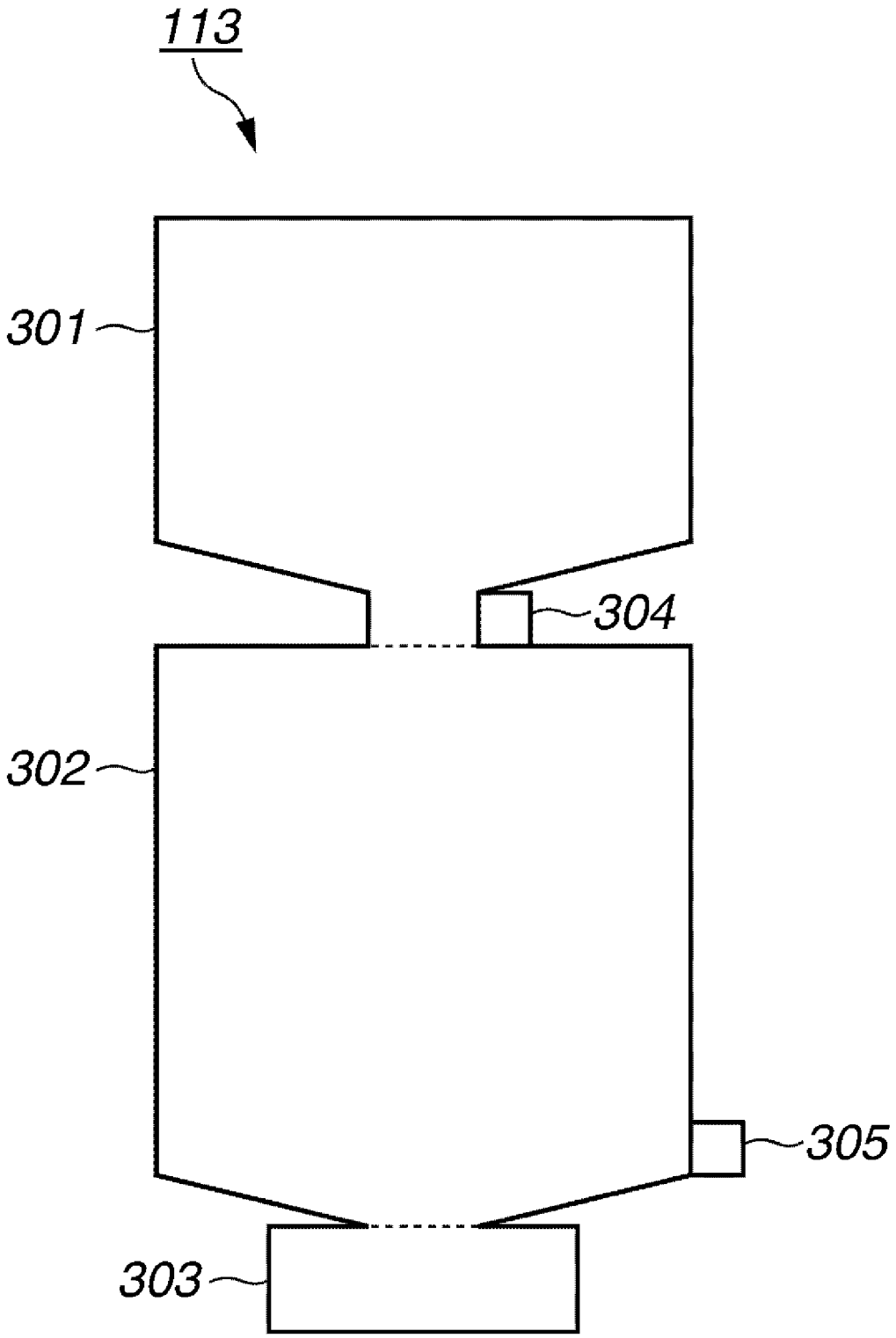
FIG. 5 illustrates an example of a configuration of a toner supply unit according to the first exemplary embodiment of the present invention.

FIG. 5 illustrates an example of a configuration of the toner supply unit 113 according to the present exemplary embodiment. The toner supply unit 113 includes a toner container 301, a toner hopper 302, a development device 303, a toner container replaceability detection unit 304, and a toner hopper toner-low detection unit 305.

The toner container 301 itself is replaceable. A toner is supplied from the toner container 301 to the toner hopper 302. When the remaining amount of toner in the toner container 301 becomes small and thus no toner can be supplied from the toner container 301 to the toner hopper 302, the printing apparatus 100 sends a notification that toner container is replaceable to the management apparatus 200. In this case, the toner container replaceability detection unit 304 detects that the toner cannot be supplied from the toner container 301 to the toner hopper 302.

The toner hopper 302 is provided to the printing apparatus 100 as a stationary toner container. The toner hopper 302 is supplied with the toner from the toner container 301 and supplies the toner to the development device 303.

When the amount of toner remaining in the toner hopper 302 becomes smaller than a threshold value, the printing apparatus 100 notifies the management apparatus 200 that the amount of toner has become small by sending a toner-low notification. In this case, the toner hopper toner-low detection unit 305 detects that the amount of toner remaining in the toner hopper 302 has become small.

The development device 303 is supplied with the toner from the toner hopper 302. The development device 303 includes a development blade and a development roller.

Figure 8:
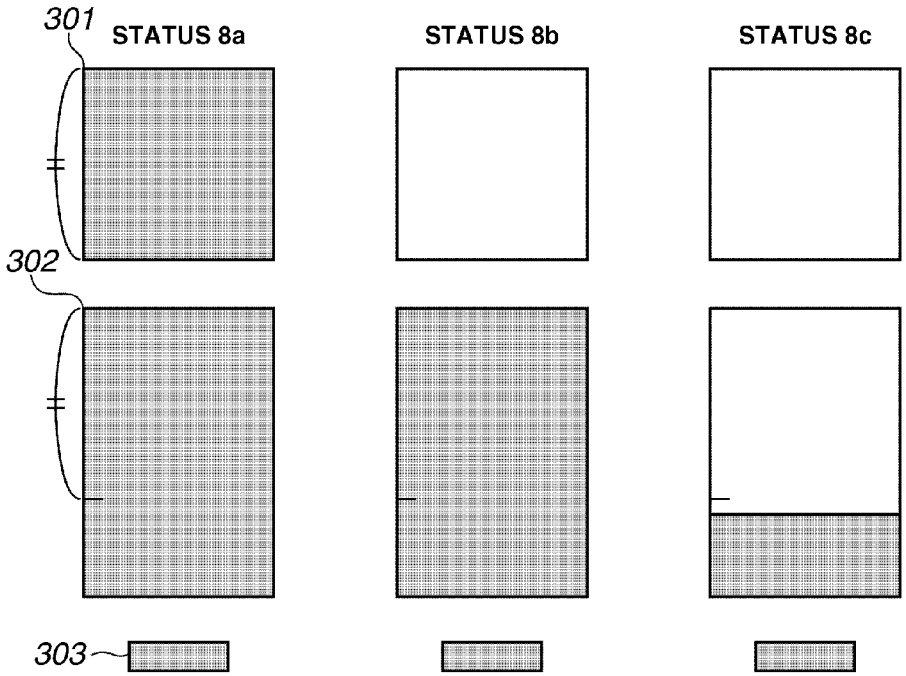
FIG. 8 illustrates an example of a method for managing a stock of toner containers according to the first exemplary embodiment of the present invention.

Referring now also to FIG. 8, when the toner container 301 has become empty and the amount of the toner remaining in the toner hopper 302 has become very small, the printing apparatus 100 is in a status 8*c*. In filling up the toner supply unit 113 in the status 8*c* with the toner, it is necessary to first replace one toner container 301 to supply the toner hopper 302 with the toner from the toner container 301.

Figure 9:
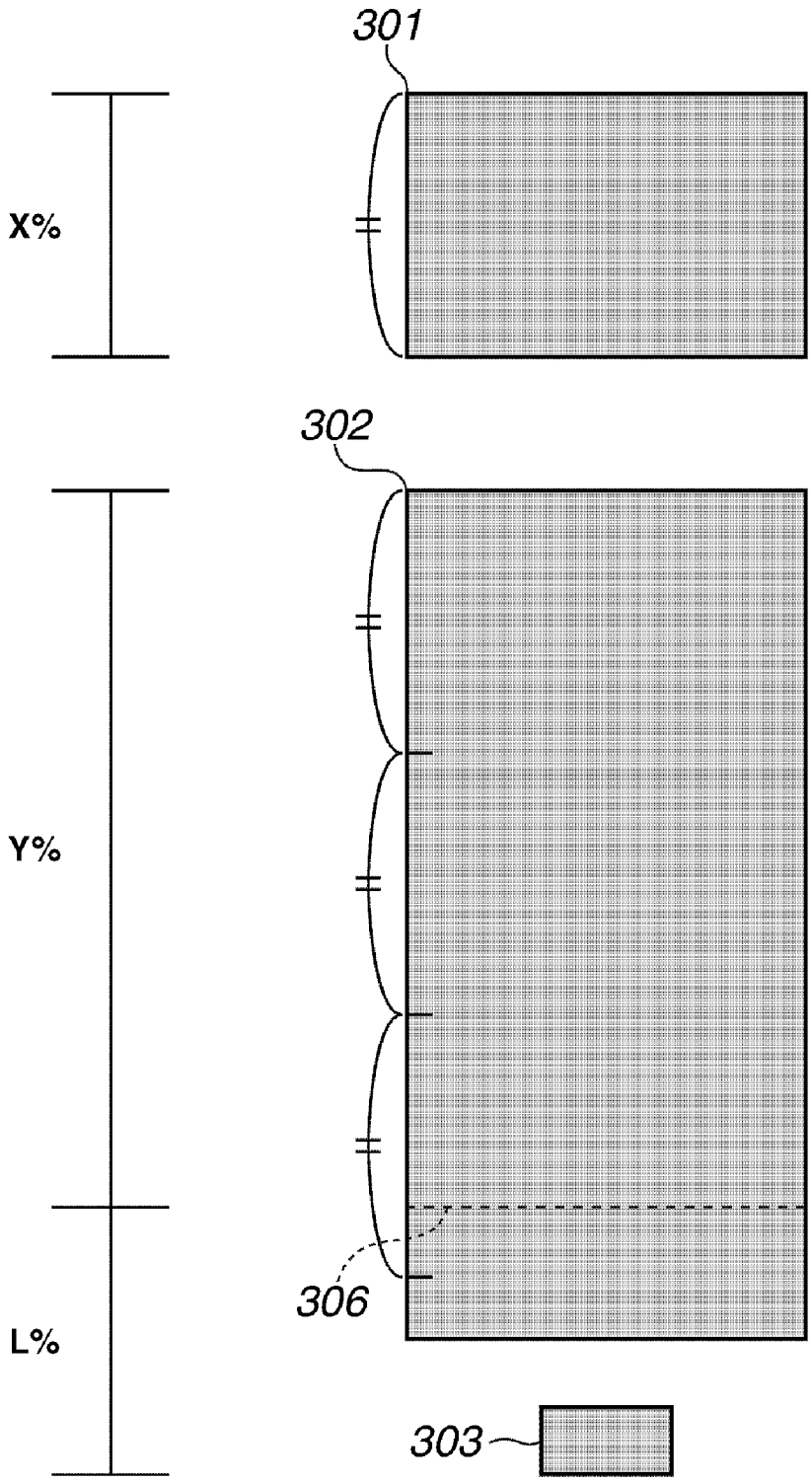
FIG. 9 schematically illustrates a ratio of the toner amount in the toner container and a toner hopper according to the first exemplary embodiment of the present invention.

Referring now also to FIG. 9, in a case where a capacity of the toner hopper 302 is much larger than a capacity of the toner container 301 as illustrated in FIG. 9, it is necessary to replace the toner container 301 several times to fill up the toner hopper 302 with the toner.

In this case, it is necessary to repeat the operation for replacing the toner container 301 several times until the toner hopper 302 is finally filled up with the toner and the toner also exists in the toner container 301 (a status 8*a* (FIG. 8)). That is, it may be necessary to replace a plurality of toner containers 301 based on one toner-low notification. In this case, a plurality of toner containers 301 may be consumed at a time in the customer stock storage location. Thus, the threat of stock shortage may be high.

If the stock quantity were always managed by decrementing the remaining quantity value for the toner container 301 by one based on one piece of toner-low information, it would be difficult to appropriately manage the stock. Accordingly, in the present exemplary embodiment, a stock of consumables is managed so that a plurality of toner containers 301 can be replaced based on one piece of toner-low information.

Figure 6:
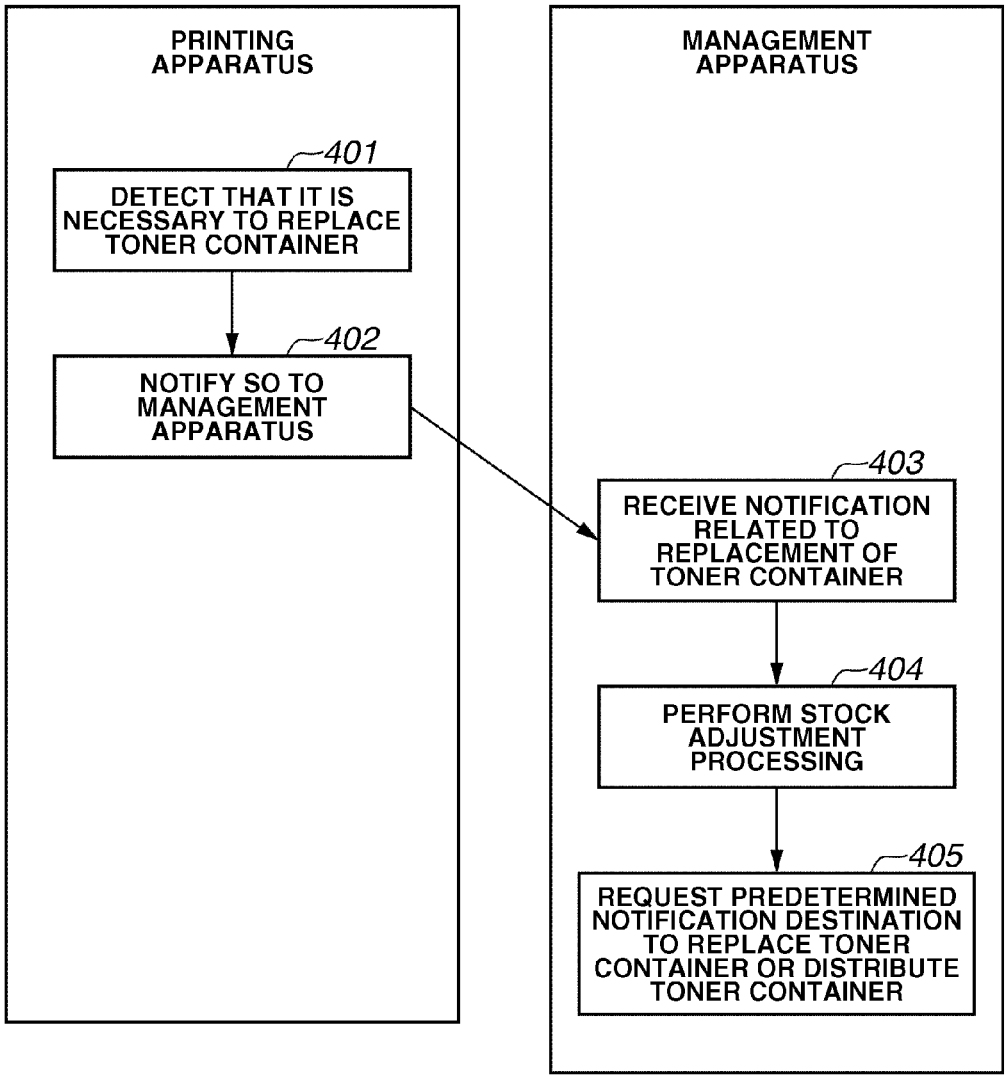
FIG. 6 illustrates an example of a flow of processing for sending a request for replacement or distribution of a toner container in the information processing system according to the first exemplary embodiment of the present invention.

FIG. 6 illustrates a flow of processing for sending a request for replacement or distribution of the toner container in the information processing system according to the present exemplary embodiment.

Referring to FIG. 6, the printing apparatus 100 detects a status in which it is necessary to replace a toner container (401). In this case, the toner container replaceability detection unit 304 and the toner hopper toner-low detection unit 305 detect the status. The toner container replaceability detection unit 185 and the toner hopper toner-low detection unit 186 process the detected information and send the detection result to the notification management unit 187.

Then, the printing apparatus 100 generates notification data and sends the generated notification data to the management apparatus 200 (402). The notification management unit 187 generates the notification data.

More specifically, the notification management unit 187 generates the data for a toner container replaceable notification based on the status information detected by the toner container replaceability detection unit 185 and generates the data for a toner-low notification based on the status information detected by the toner hopper toner-low detection unit 186. The communication unit 188 sends the thus generated notification data.

The management apparatus 200 receives the notification data sent from the printing apparatus 100 (403). The notification management unit 202 determines whether the received notification data is related to the replacement of the toner container. If it is determined that the received notification data is related to the replacement of the toner container, then the notification management unit 202 issues a request for performing stock adjustment to the stock management unit 204.

Then, the management apparatus 200 performs the stock adjustment with the stock management unit 204 (404). The stock management unit 204 calculates the number of toner containers to be replaced and derives the stock quantity in the stock storage location.

If it is determined necessary to replace or distribute the toner container after the above-described stock adjustment processing, the notification management unit 202 generates a toner container replacement request notification or a toner container distribution request notification, and then sends the generated notification to a predetermined notification destination (405). Here, the notification destination refers to a service contractor that offers a consumable distribution service.

Figure 7:
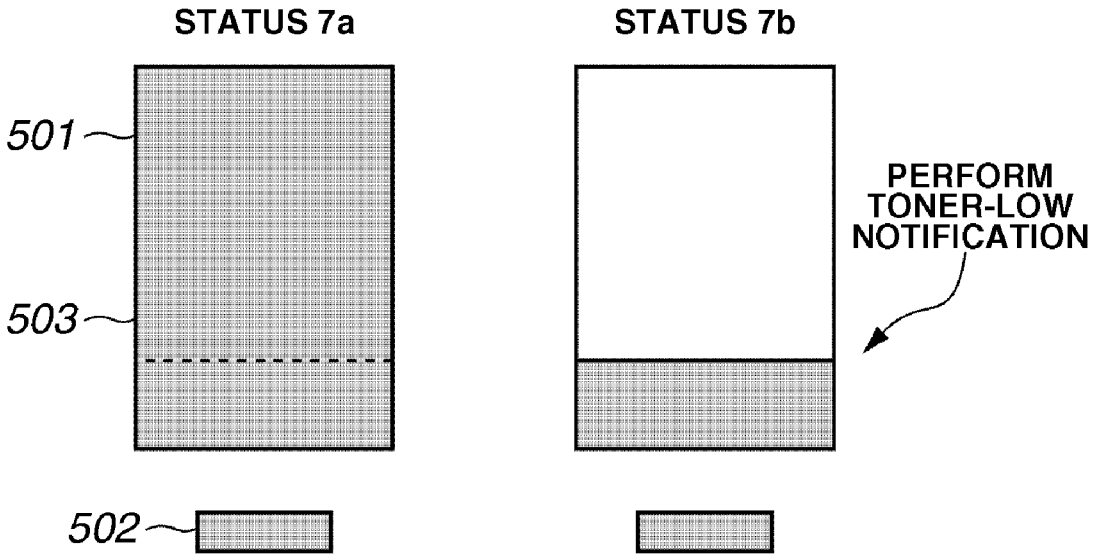
FIG. 7 illustrates an example of a conventional method for managing a stock of toner containers.

FIG. 7 illustrates a conventional method for managing a stock of toner containers.

Referring to FIG. 7, a conventional toner supply unit includes a replaceable toner container 501 and a development device 502. The toner container 501 includes a toner-low detection unit (not illustrated) for detecting whether the amount of toner remaining in a toner container has become small.

As illustrated in a status 7*a*, a value 503 indicates a toner-low threshold value. In the status 7*a*, the toner container 501 and the development device 502 are filled up with the toner. When the toner in the toner container 501 and the development device 502 is consumed and thus the toner remaining amount value becomes as low as the toner-low threshold value 503 (a status 7*b*), a printing apparatus sends a toner-low notification to a management apparatus.

When the management apparatus receives the toner-low notification from the printing apparatus, the management apparatus decrements the quantity of the stock in the stock storage location on the customer side by one. In addition, the management apparatus sends a toner container replacement request notification to a replacement service contractor. If the storage quantity reaches the notification threshold value as a result of the stock adjustment, then the management apparatus sends a toner container distribution request to a distributor.

FIG. 8 illustrates a method for managing a stock of toner containers according to the present exemplary embodiment. Referring to FIG. 8, the toner supply unit 113 according to the present exemplary embodiment includes the replaceable toner container 301, the stationary toner hopper 302, and the development device 303, as already described above with reference to FIG. 5.

In the status 8*a*, the toner container 301, the toner hopper 302, and the development device 303 are filled up with the toner. When the toner is consumed and thus the toner container 301 cannot supply the toner hopper 302 with toner (a status 8*b* in FIG. 8), the printing apparatus 100 sends a toner container replaceable notification to the management apparatus 200.

At this time, the printing apparatus 100 is in the status 8*b*. Accordingly, in this status, the management apparatus 200 can decrement the stock quantity value in the stock storage location on the customer side by one. If the toner container 301 can be immediately replaced in this case, the stock may be managed with the method in which the stock quantity value is decremented by one based on the toner container replaceable notification.

However, if the toner container 301 is not immediately replaced and the printing apparatus 100 continues to operate in such a state, then the status of the printing apparatus 100 shifts to the status 8*c*. When the replacement contactor (an in-charge service person of the replacement contractor) replaces the toner container in the status 8*c* and fills up the toner supply unit 113 (the status 8*a*), the replacement service person performs the following operations.

First, the replacement service person replaces one toner container 301 to replenish the toner hopper 302 with the toner. As the toner hopper 302 is replenished with the toner, the toner container 301 becomes empty. Then, the service person replaces one more toner container 301 to replenish the toner container 301, which has become empty at this time, with the toner. For example, it may be necessary to replace not one but two toner containers to restore from the status 8*c* to the status 8*a*.

In the case where the toner supply unit 113 has the configuration illustrated in FIG. 5, the stock quantity of toner containers cannot be appropriately calculated with a conventional stock management method. In the present exemplary embodiment, the management apparatus 200 decrements the stock quantity value when a toner container replacement request notification is received because it can be considered in advance that the toner container is to be replaced by a replacement service contractor.

If the printing apparatus 100 adjusts the stock after the toner container is replaced, it is highly possible that replenishment of stocks in the stock storage location may be late. However, according to the present exemplary embodiment, if it can be predicted that the stock quantity may become small, then the stock adjustment can be performed and the stocks can be replenished into the stock storage location soon enough.

FIG. 9 schematically illustrates a ratio of the toner amount in the toner container 301 and the toner hopper 302 according to the present exemplary embodiment. The development device 303, toner-low threshold value 306, and various capacities are also shown, as described below.

When the printing apparatus 100 consumes the toner in the toner container 301 and thus the toner container 301 has become empty, the printing apparatus 100 sends a toner container replaceable notification to the management apparatus 200. When the management apparatus 200 receives the toner container replaceable notification from the printing apparatus 100, the management apparatus 200 decrements the stock quantity value in the toner container 301 in the stock storage location by one.

If the toner in the toner hopper 302 is consumed to a specific extent without replacing the toner container 301 and thus the toner remaining amount reaches a toner-low threshold value 306, then the printing apparatus 100 sends a toner-low notification to the management apparatus 200. When the management apparatus 200 receives the toner-low notification from the printing apparatus 100, basically, the management apparatus 200 decrements the number of the toner containers 301 by a value N as described more fully below. The definition of the value N will be described in detail later below. To be brief, the value N stands for a number of toner containers to be used to fill up the toner hopper 302 with the toner.

[The Definition of the Value N]

Where the entire capacity of the toner supply unit 113 (FIG. 9) is 100(%), the capacity of the toner container 301 is X (%), the capacity of the toner hopper 302 up to the toner-low threshold value 306 is L (%), and the capacity of the toner hopper 302 except the capacity equivalent to the toner-low threshold value 306 is Y (%), then X (%)=100−(Y+L). In this case, the value N is a quotient of Y/X.

The method for decrementing the stock according to the present exemplary embodiment includes another rule, besides the above-described basic processing of decrementing the stock by N. In particular, the management apparatus 200 does not decrement the stock based on toner container replaceable notifications issued for consecutive N times after a toner-low notification. This rule is applied because the decrement of stock has been previously performed since the remaining stock quantity corresponding to N container replaceable notifications has been allocated based on the toner-low notification.

The management apparatus 200 decrements the stock quantity of the toner containers 301 by one in the case of receiving more than N consecutive toner container replaceable notifications after a toner-low notification.

When N toner containers 301 are replaced in a state in which the toner remaining amount is equal to the toner-low threshold value 306, the toner hopper 302 is not filled up with the toner in most cases. On the other hand, in the case where one toner container 301 is replaced based on a toner container replaceable notification issued before a toner-low notification, both the toner container 301 and the toner hopper 302 are filled up with the toner. In this case, the value "N+1" to be decremented from the stock quantity managed by the management apparatus 200 matches the number of the toner containers 301 that have been actually replaced (the number of the actually replaced toner containers 301 in this case is also "N+1").

In the case where (N+1) toner containers 301 are consecutively replaced after a toner-low notification, the status in which the toner container 301 and the toner hopper 302 are filled up with the toner is restored. If consecutive N toner container replaceable notifications are received during a time period in which the printing apparatus 100 is in this status, the management apparatus 200 does not decrement the stock quantity.

Figure 10:
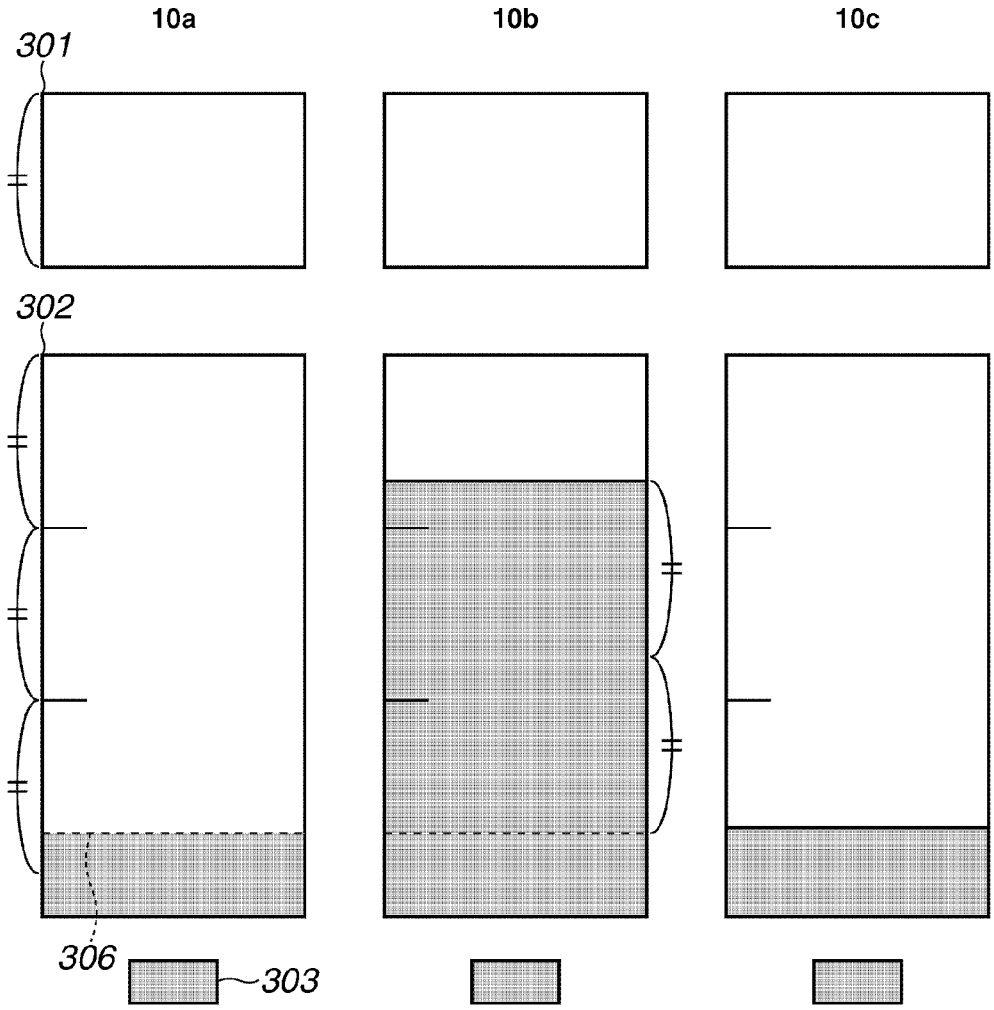
FIG. 10 illustrates an example of a method for managing a stock of toner containers according to the first exemplary embodiment of the present invention.

Reference is now made also to FIG. 10. FIG. 10 illustrates an example of a method for managing a stock of toner containers according to the present exemplary embodiment.

When (N+1) toner containers 301 are not consecutively replaced but only M toner containers (the definition of the value "M" are described below) are replaced after a toner-low notification is received, a toner-low may be detected again. If the stock quantity is decremented by N based on a notification of the detected toner-low, the stock quantity that the management apparatus 200 manages may become incorrect.

Here, to replace (N+1) toner containers, a status is shifted from a status 10*a* in FIG. 10 to a status in which both the toner container 301 and the toner hopper 302 are filled up with the toner. After M toner containers are replaced (a status 10*b*), the status shifts to a status 10*c*.

The number of toner containers 301 required to shift from the status 10*c* to the state in which both the toner container 301 and the toner hopper 302 are filled up with the toner is also (N+1) in this case. In the present exemplary embodiment, when a toner-low notification is issued to the management apparatus 200 after the status has shifted from the status 10*b* to the status 10*c*, the management apparatus 200 decrements the stock by M.

In other words, when a first toner-low notification is issued and then a second toner-low notification is issued after less than (N+1) toner container replaceable notifications are received, the management apparatus 200 decrements the stock by M. The value "M" stands for the number of toner container replaceable notifications issued after a toner-low notification. Here, when a second toner-low notification described above is received, M=0.

The quantity of stocks the management apparatus 200 decrements based on the toner-low notification (FIG. 9) is determined as follows. The management apparatus 200 decrements the stock by N based on a toner-low notification received after receiving (N+1) or more toner container replaceable notifications.

Figure 11:
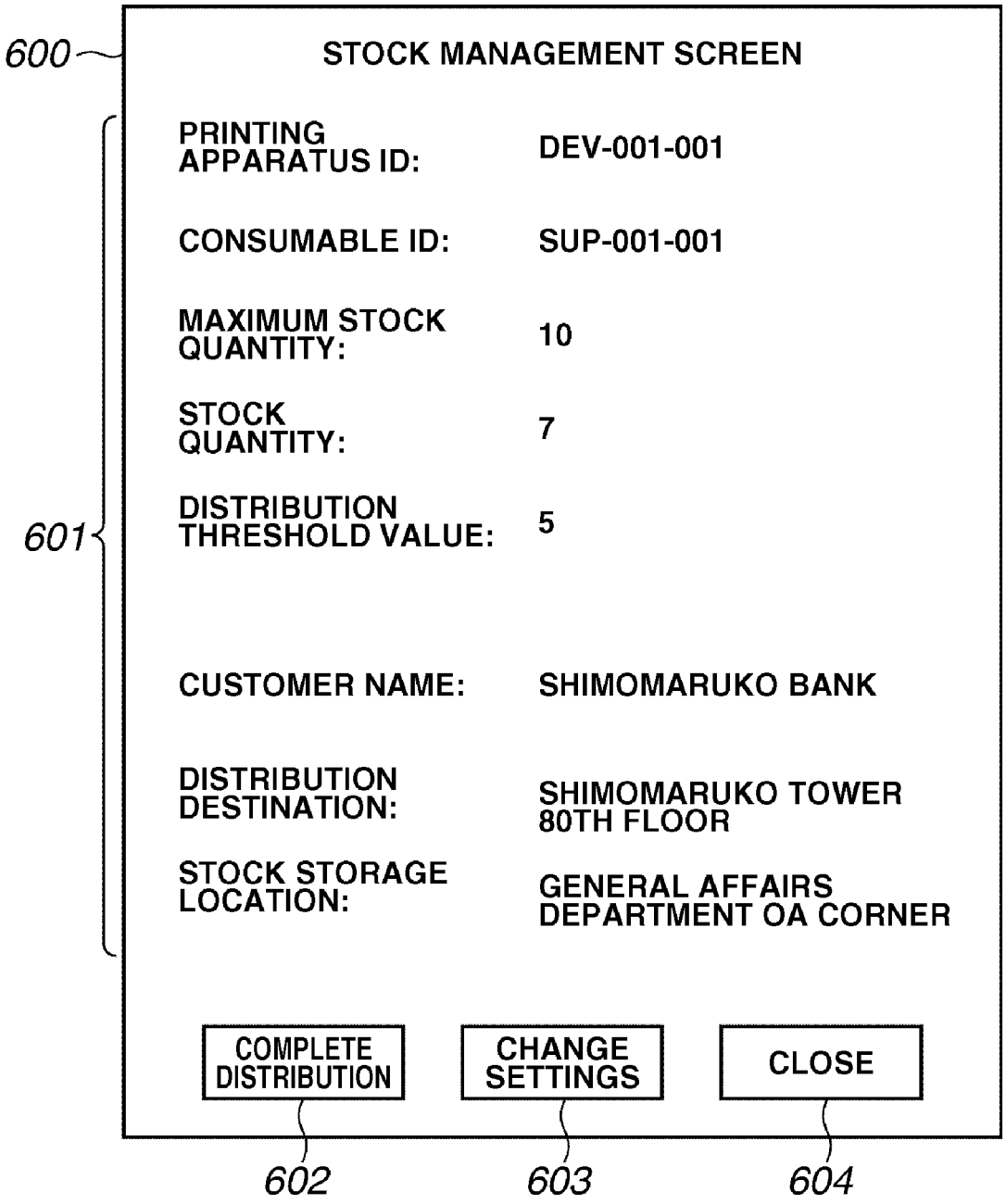
FIG. 11 illustrates an example of a toner container stock management screen of the management apparatus according to the first exemplary embodiment of the present invention.

FIG. 11 illustrates an example of a toner container (toner container 301) stock management screen 600 of the management apparatus 200 according to the present exemplary embodiment.

Referring to FIG. 11, the stock management screen 600 is a screen for managing the stock quantity of the toner containers 301 in the printing apparatus 100, which a specific customer uses.

A display portion 601 displays following various information. Namely, the display portion 601 displays a printing apparatus ID corresponding to the printing apparatus 100 and a consumable ID for the toner container 301 that the printing apparatus 100 uses. The printing apparatus ID indicates a model type of the printing apparatus 100. However, instead of the printing apparatus ID, which indicates a model type, an individual printing apparatus ID, which is allocated to each individual printing apparatus, can be displayed.

Furthermore, the display portion 601 displays a maximum quantity of stocks that can be stored at a customer's stock storage location, a current stock quantity, and a distribution threshold value, which indicates a stock quantity value at which the management apparatus 200 starts processing for requesting a distribution of the toner container 301. Moreover, the display portion 601 displays a customer name, a consumable distribution destination, and a stock storage location.

A "complete distribution" button 602 can be operated to issue an instruction for starting processing for matching the stock quantity with the maximum stock quantity when a distribution is completed. A "change settings" button 603 can be operated to issue an instruction for displaying a screen (not illustrated) for changing the maximum stock quantity or the distribution threshold value and starting setting change processing. A "close" button 604 can be operated to issue an instruction for closing the stock management screen 600.

FIG. 12 illustrates an example of a replacement request notification 700, which is sent to a replacement contractor that replaces the toner container 301 when the management apparatus 200 receives a toner container replaceable notification, according to the present exemplary embodiment.

Referring to FIG. 12, in the replacement request notification 700, an account for the management apparatus 200 is set in a sending destination field. A contact address of a specific replacement contractor is set in a sending source field. The contact address of the replacement contractor is previously registered. A previously fixed subject can be used for the replacement request notification 700. With respect to a text of the replacement request notification 700, a previously fixed content can be used, as long as the text describes that the toner container 301 has become empty and has a content prompting the replacement of the toner container 301.

FIG. 13 illustrates an example of a replacement request notification 800, which is sent to a replacement contractor that replaces the toner container 301 when the management apparatus 200 receives a toner-low notification with respect to the toner hopper 302, according to the present exemplary embodiment.

Referring to FIG. 13, in the replacement request notification 800, an account for the management apparatus 200 is set in a sending source field. A contact address of a specific replacement contractor is set in a sending destination field. The contact address of the replacement contractor is previously registered. A previously fixed subject can be used for the replacement request notification 800. With respect to a text of the replacement request notification 800, a previously fixed content can be used, as long as the text describes that the amount of the toner that the printing apparatus 100 can use has become very small, has a content prompting the replacement of the toner container 301, and describes that it is necessary to replace a plurality of toner containers 301 and N toner containers 301 are to be replaced at a maximum.

FIG. 14 illustrates an example of a distribution request notification 900, which is sent to a distributor that distributes the toner container 301 when the quantity of the stocks in the stock storage location has reached the distribution threshold value after processing by the stock management unit 204, according to the present exemplary embodiment.

Referring to FIG. 14, in the distribution request notification 900, an account for the management apparatus 200 is set in a sending source field. A contact address of a specific distributor is set in a sending destination field. The contact address of the distributor is previously registered. A previously fixed subject can be used for the distribution request notification 900. A text includes, as its content, a request of the distribution of the toner container 301, which includes a customer name, a distribution destination, a printing apparatus ID, a consumable ID, and a number of the toner containers 301 to be distributed. An individual printing apparatus ID, which is allocated to each individual printing apparatus, can be added to the text FIG. 15 illustrates an example of a data content 1000 of a toner container replaceable notification sent from the printing apparatus 100 to the management apparatus 200 according to the present exemplary embodiment.

Referring to FIG. 15, the data content 1000 includes notification destination information, sending source information, an individual printing apparatus ID, a status ID, and a consumable ID.

The notification destination is previously set on the printing apparatus 100. The notification destination is a specific notification destination for the management apparatus 200. The sending source field indicates a sending source of a communication, which is allocated to the printing apparatus 100. The notification can be sent via an e-mail or via the Internet via HTTP. An individual printing apparatus ID describes information for identifying each individual printing apparatus. The status ID indicates that it is currently necessary to replace the toner container 301. The consumable ID indicates information for identifying a consumable to be replaced based on the corresponding notification.

FIG. 16 illustrates an example of a data content 1100 of a toner-low notification with respect to the toner hopper 302 sent from the printing apparatus 100 to the management apparatus 200 according to the present exemplary embodiment.

Referring to FIG. 16, the data content 1100 includes notification destination information, sending source information, an individual printing apparatus ID, a status ID, and a consumable ID.

The notification destination is previously set on the printing apparatus 100. The notification destination is a specific notification destination for the management apparatus 200. The sending source field indicates a sending source of a communication, which is allocated to the printing apparatus 100. The notification can be sent via an e-mail or via the Internet via the HTTP. An individual printing apparatus ID describes information for identifying each individual printing apparatus. The status ID indicates that the amount of toner remaining in the toner hopper 302 has been very small. The consumable ID indicates information for identifying a consumable to be replaced based on the corresponding notification.

FIG. 17 illustrates an example of a customer information database managed by the management apparatus 200 according to the present exemplary embodiment.

Referring to FIG. 17, a customer ID field 1201 describes information that the management apparatus 200 uses to identify an owner of the printing apparatus 100. A customer name field 1202 describes a name of a customer corresponding to the customer ID 1201. Customer access information field 1203 describes a contact address of a customer. The customer access information field 1203 can include a postal address, a telephone number, and an e-mail address.

Replacement contractor contact information field 1204 describes a destination of a toner container replaceable notification sent from the management apparatus 200. A replacement notification field 1205 describes information for instructing whether to send a replacement request notification to the replacement contractor 1204.

A number of printing apparatuses field 1206 describes a total number of printing apparatuses 100 that a customer owns. A printing apparatus ID field 1207 describes information for identifying model type of each printing apparatus 100 that the customer owns. An individual printing apparatus ID field 1208 describes information for identifying each printing apparatus 100 that the customer owns.

FIG. 18 illustrates an example of a notification information database managed by the management apparatus 200 according to the present exemplary embodiment.

Referring to FIG. 18, a notification type ID field 1301 describes information for identifying various notification information to be notified by the management apparatus 200 to a replacement contractor or a distributor. A subject field 1302 describes a subject of a notification corresponding to the notification type ID 1301. A text field 1303 describes a content of a text of a notification corresponding to the notification type ID 1301.

FIG. 19 illustrates an example of a status information database managed by the management apparatus 200 according to the present exemplary embodiment.

Referring to FIG. 19, a status ID field 1401 describes information for identifying an operation status of the printing apparatus 100. A status name field 1402 describes a name of an operation status of the printing apparatus 100 corresponding to the status ID 1401. A notification type ID field 1403 describes notification information corresponding to the status ID 1401.

FIG. 20 illustrates an example of a printing apparatus database managed by the management apparatus 200 according to the present exemplary embodiment. Referring to FIG. 20, a printing apparatus ID field 1501 describes information for identifying a model type of the printing apparatus 100. A printing apparatus name field 1502 describes a name of the printing apparatus 100 corresponding to the printing apparatus ID 1501.

FIG. 21 illustrates an example of a consumable database managed by the management apparatus 200 according to the present exemplary embodiment.

Referring to FIG. 21, a consumable ID field 1601 describes information for identifying a consumable such as the toner container 301. A consumable name field 1602 describes a name of the consumable corresponding to the consumable ID 1601. A usable in printing apparatus field 1603 describes the printing apparatus ID of the printing apparatus 100 that can use the consumable corresponding to the consumable ID 1601.

FIG. 22 illustrates an example of a stock management database managed by the management apparatus 200 according to the present exemplary embodiment.

Referring to FIG. 22, a customer ID field 1701 describes information for identifying a customer. A stock quantity field 1702 describes the number of consumables stored in a specific stock storage location and managed by the management apparatus 200. A maximum stock quantity field 1703 describes a maximum number of consumables that can be stored in a specific stock storage location and managed by the management apparatus 200.

A notification threshold value field 1704 describes the stock quantity of consumables. When the stock quantity of consumables reaches the notification threshold value 1704, the management apparatus 200 starts processing for sending a consumable distribution request notification. An N value field 1705 describes a value N, which is a base of the stock quantity value to be decremented when the management apparatus 200 receives a toner-low notification with respect to the toner hopper 302. An M value field 1706 describes an M value, which indicates a number of toner container replaceable notifications received after a toner-low notification is received. A consumable ID field 1707 describes information for identifying a consumable such as the toner container 301.

A stock storage location field 1708 describes a location for storing the consumable corresponding to the consumable ID 1707. If a plurality of stock storage locations 1708 correspond to one customer ID 1701, different record information is allocated to each stock storage location 1708. If a plurality of consumable IDs 1707 corresponds to one customer ID 1701 and one stock storage location 1708, different record information is allocated to each consumable ID 1707.

FIG. 23 illustrates an example of a distributor database managed by the management apparatus 200 according to the present exemplary embodiment.

Referring to FIG. 23, a distributor ID 1801 is information for identifying a distribution service person or a distributor itself that distributes the toner container 301 to the customer. A distributor name 1802 is a name of a distribution service person or a distributor itself that corresponds to the distributor ID 1801.

A distributor contact information 1803 describes contact information about the distributor corresponding to the distributor ID 1801, to which the management apparatus 200 sends a distribution request notification. A number of customers 1804 describes the number of customers to whom the distributor is in charge of distributing the toner. A customer ID 1805 describes information for identifying the customer or customers to whom the distributor is in charge of distributing the toner.

Figure 24:
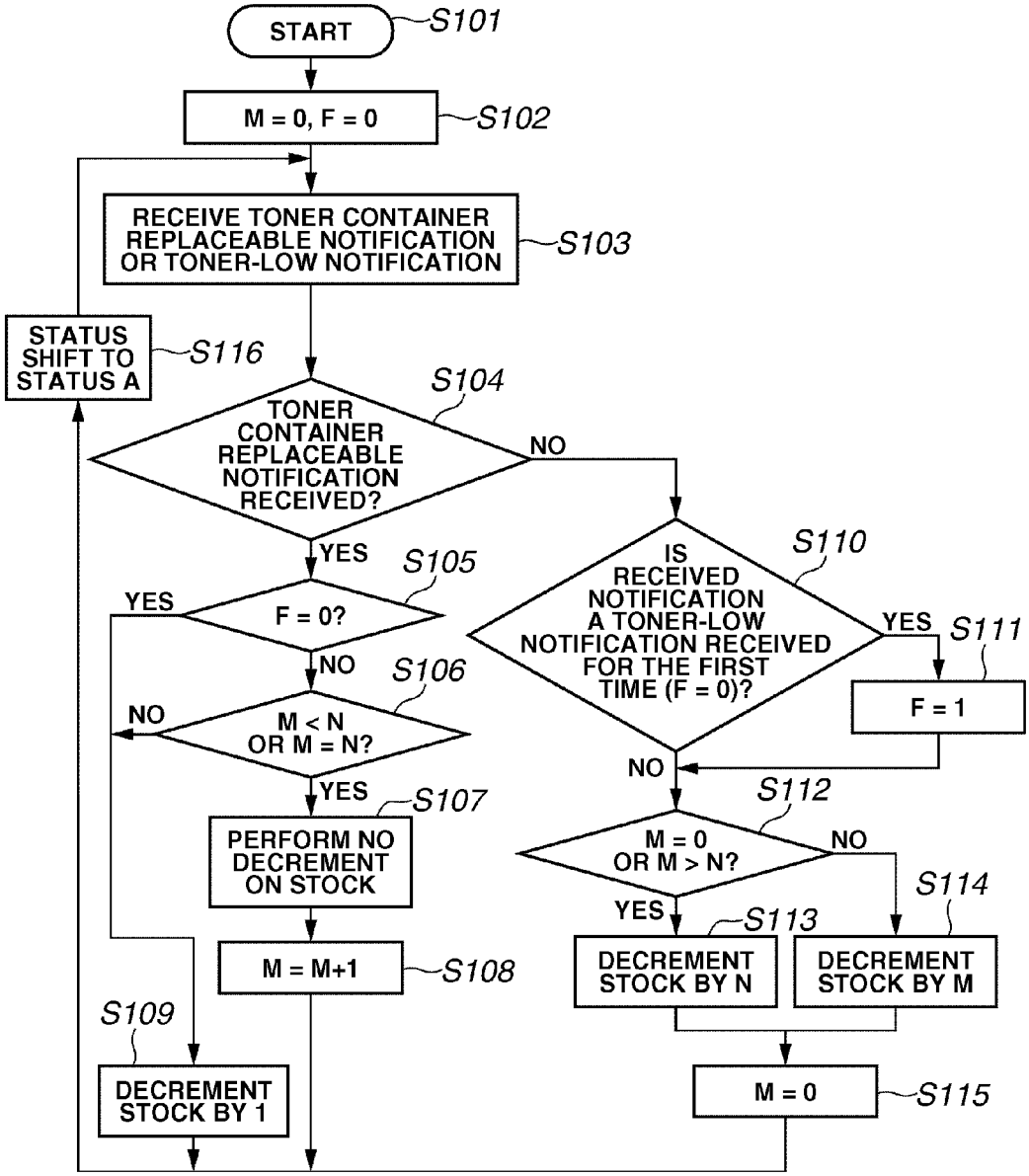
FIG. 24 is a flow chart illustrating an example of processing performed by the management apparatus based on a program for managing the stock quantity of the toner containers according to the first exemplary embodiment of the present invention.

FIG. 24 is a flow chart illustrating an example of processing performed by the management apparatus 200 based on a program for managing the stock quantity of the toner containers 301 according to the present exemplary embodiment. More specifically, the processing illustrated in FIG. 24 includes processing for calculating the stock quantity of the toner containers 301 stored in a stock storage location of a customer.

Referring to FIG. 24, in step S101, the management apparatus 200 starts the processing. In step S102, the management apparatus 200 sets M=0 and F=0. The value M stands for the number of toner container replaceable notifications received after a toner-low notification is received. "F" is a flag used for determining whether the management apparatus 200 has ever received a toner-low notification. In the case where F=0, the value "0" set to the flag F indicates that the management apparatus 200 has never received a toner-low notification. The value M is incremented as the management apparatus 200 receives a toner container replaceable notification during a time period after receiving a toner-low notification and before receiving another toner-low notification. The maximum value for M is N.

In step S103, the management apparatus 200 receives a toner container replaceable notification or a toner-low notification from the printing apparatus 100. In step S104, the management apparatus 200 determines whether a toner container replaceable notification has been received. If it is determined in step S104 that a toner container replaceable notification has been received (Yes in step S104), then the management apparatus 200 advances to step S105. On the other hand, if it is determined in step S104 that no toner container replaceable notification has been received but a toner-low notification has been received (No in step S104), then the management apparatus 200 advances to step S110.

In step S105, the management apparatus 200 determines whether F=0. That is, the management apparatus 200 determines in step S105 whether a toner container replaceable notification has been received in the case where a toner-low notification has never been received.

If it is determined in step S105 that F=0 (Yes in step S105), then the management apparatus 200 advances to step S109. In step S109, the management apparatus 200 decrements the stock quantity of the toner containers 301 by one. The processing in step S109 is performed to correctly manage the stock quantity even in the case where the management apparatus 200 has never received a toner-low notification. On the other hand, if it is determined in step S105 that F≠0 (No in step S105), then the management apparatus 200 advances to step S106.

In step S106, the management apparatus 200 determines whether M≦N. More specifically, in step S106, the management apparatus 200 determines whether the value M, which stands for the number of toner container replaceable notifications received after a toner-low notification, is smaller than the value (N+1), which stands for the number of times of toner container replacements required to fill up both the toner hopper 302 and the toner container 301 with the toner.

If it is determined in step S106 that M≦N, namely, if the toner replacements have not been performed for a number of times large enough to fill up both the toner hopper 302 and the toner container 301 (Yes in step S106), then the management apparatus 200 advances to step S107. On the other hand, if it is determined in step S106 that M>N (No in step S106), then the management apparatus 200 advances to step S109.

In step S107, the management apparatus 200 does not decrement the stock based on the received toner container replaceable notification.

In step S108, the management apparatus 200 increments the value M by one.

After completing the processing of step S108 or step S109, the status shifts to a status A. Then, the management apparatus 200 returns to step S103. The status A refers to a status in which the management apparatus 200 has adjusted the stock quantity of the toner containers 301.

As noted above, if it is determined in step S104 that no toner container replaceable notification has been received but a toner-low notification has been received (No in step S104), then the management apparatus 200 advances to step S110. In step S110, the management apparatus 200 determines whether F=0.

If it is determined in step S110 that F=0 (that the toner-low notification has been received for the first time) (Yes in step S110), then the management apparatus 200 advances to step S111. In step S111, the management apparatus 200 sets F=1, and then, the management apparatus 200 advances to step S112. On the other hand, if it is determined in step S110 that F≠0 (No in step S110), then the management apparatus 200 advances to step S112.

In step S112, the management apparatus 200 determines whether M=0 or M>N. Here, if M=0, no toner container replaceable notification has ever been received after a last toner-low notification. The management apparatus 200 determines whether the received notification is a toner-low notification issued after more than or equal to (N+1) toner containers, which are required to fill up both the toner hopper 302 and the toner container 301, have been replaced.

If it is determined in step S112 that M=0 or M>N (Yes in step S112), then the management apparatus 200 advances to step S113. On the other hand, if it is determined in step S112 that neither M=0 nor M>N (No in step S112), then the management apparatus 200 advances to step S114.

In step S113, the management apparatus 200 decrements the stock quantity by N, and then the management apparatus 200 advances to step S115. In step S114, the management apparatus 200 decrements the stock quantity by M, and then the management apparatus 200 advances to step S115. In step S115, the management apparatus 200 sets M=0. After performing step S115, the process continues at step S116 wherein the status shifts to the status A. Then, the management apparatus 200 returns to step S103.

The management apparatus 200 decrements the stock in following patterns. That is, the management apparatus 200 has two patterns of decrementing the stock based on a toner container replaceable notification:

1. The management apparatus 200 does not decrement the toner stock quantity in the case of receiving up to N consecutive toner container replaceable notifications after a toner-low notification.

2. The management apparatus 200 decrements the toner stock quantity by one, except for the case of receiving toner container replaceable notifications described in the pattern 1 above.

The management apparatus 200 has two patterns of decrementing the stock based on a toner-low notification:

3. The management apparatus 200 decrements the toner stock quantity by N in the case of receiving a toner-low notification for the first time (M=0) or a toner-low notification received after receiving (N+1) or more consecutive toner container replaceable notifications.

4. The management apparatus 200 decrements the toner stock quantity by M in the case of receiving a toner-low notification received after receiving less than (N+1) consecutive toner container replaceable notifications (except for the case of receiving a toner-low notification for the first time (M=0)).

Figure 25:
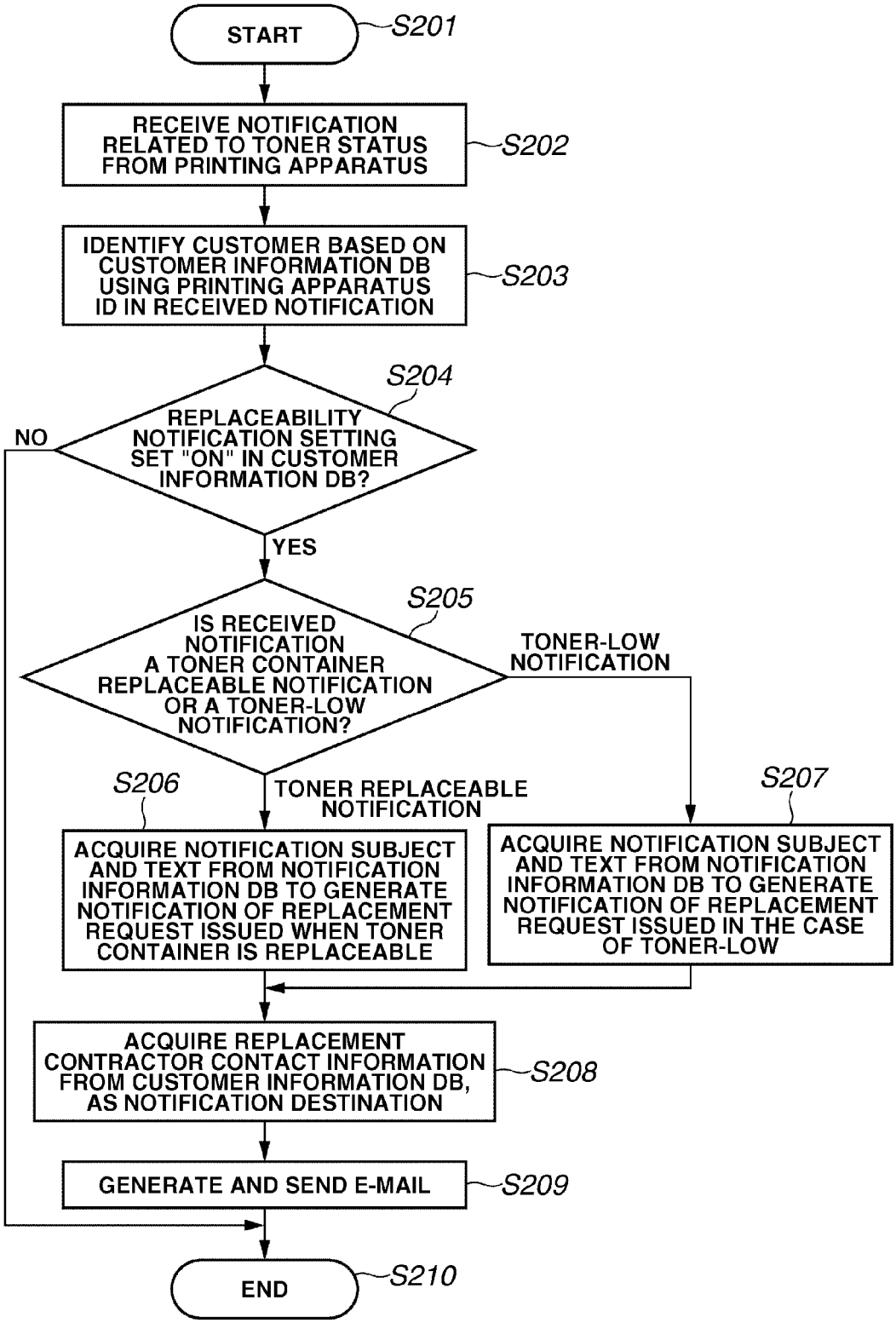
FIG. 25 is a flow chart illustrating an example of processing performed by the management apparatus based on a program that implements processing performed after receiving a toner container replaceable notification and before sending a toner container replacement request notification to a replacement contractor (a replacement service person), according to the first exemplary embodiment of the present invention.

FIG. 25 is a flow chart illustrating an example of processing performed by the management apparatus 200 based on a program that implements processing after receiving a toner container replaceable notification and before sending a toner container replacement request notification to a replacement contractor (a replacement service person) according to the present exemplary embodiment.

Referring to FIG. 25, in step S201, the management apparatus 200 starts the processing. In step S202, the management apparatus 200 receives a toner container replaceable notification or a toner-low notification from the printing apparatus 100.

In step S203, the management apparatus 200 refers to the customer information database to identify a customer, using the printing apparatus ID included in the notification received in step S202. In step S204, the management apparatus 200 determines whether the customer identified within the customer information database has set the setting for a replacement notification ON.

If it is determined in step S204 that the identified customer has set the setting for a replacement notification ON (Yes in step S204), then the management apparatus 200 advances to step S205. On the other hand, if it is determined that the identified customer has not set the setting for a replacement notification ON (No in step S204), then the management apparatus 200 advances to step S210 wherein the process ends.

In step S205, the management apparatus 200 determines whether a toner container replaceable notification or a toner-low notification has been received. If it is determined that a toner container replaceable notification has been received, then the management apparatus 200 advances to step S206. On the other hand, if it is determined that a toner-low notification has been received, then the management apparatus 200 advances to step S207.

In step S206, the management apparatus 200 refers to the notification information database to acquire a subject and a text for a replacement request notification. Using the subject and text, the management apparatus 200 generates a replacement request notification that is necessary in the case of receiving a toner container replaceable notification from the printing apparatus 100. Then, the management apparatus 200 advances to step S208.

In step S207, the management apparatus 200 refers to the notification information database to acquire a subject and a text for a replacement request notification. Using the subject and text, the management apparatus 200 generates a replacement request notification that is necessary in the case of receiving a toner-low notification from the printing apparatus 100. Then, the management apparatus 200 advances to step S208.

In step S208, the management apparatus 200 refers to the customer information database to acquire contact information about a replacement contractor as a notification sending destination. In step S209, the management apparatus 200 generates a replacement request notification and then sends the generated replacement request notification via e-mail. In step S210, the management apparatus 200 ends the processing.

Figure 26:
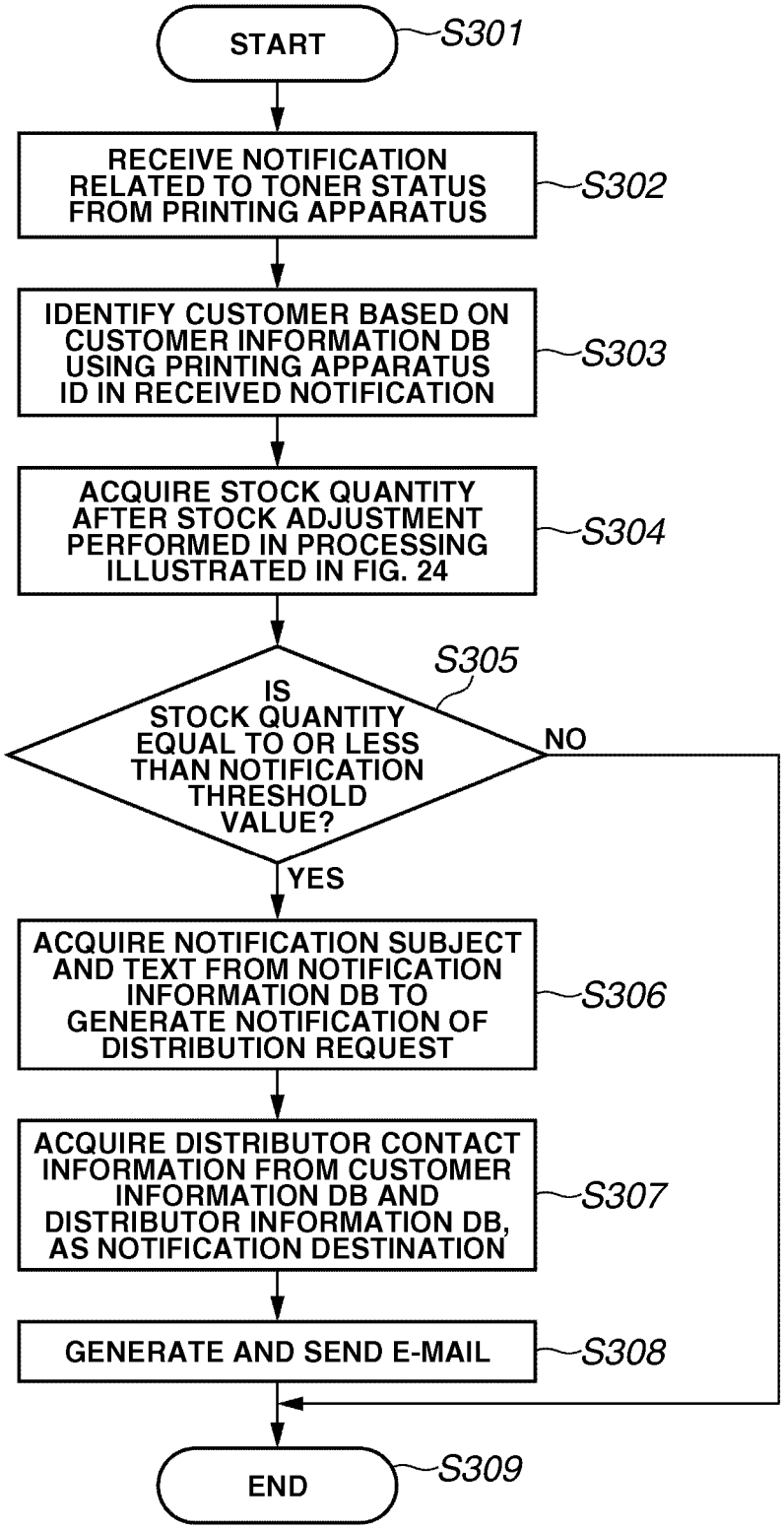
FIG. 26 is a flow chart illustrating an example of processing performed by the management apparatus based on a program that implements processing for decrementing the stock, determining whether the distribution of a toner container is necessary, and sending a toner container distribution request notification to a replacement contractor (a replacement service person), according to the first exemplary embodiment of the present invention.

FIG. 26 is a flow chart illustrating an example of processing performed by the management apparatus 200 based on a program that implements processing for decrementing the stock, determining whether the distribution of a toner container 301 is necessary, and sending a toner container distribution request notification to a replacement contractor (a replacement service person), according to the present exemplary embodiment.

Referring to FIG. 26, in step S301, the management apparatus 200 starts the processing. In step S302, the management apparatus 200 receives a toner container replaceable notification or a toner-low notification from the printing apparatus 100.

In step S303, the management apparatus 200 refers to the customer information database to identify a customer using the printing apparatus ID included in the notification received in step S302. In step S304, the management apparatus 200 acquires the stock quantity of the toner containers 301 in the status A, which is a status after the management apparatus 200 has adjusted the stock quantity of the toner containers 301 by the processing in the flow chart of FIG. 24. Here, the processing in the flow chart of FIG. 24 can be dynamically performed to adjust the stock quantity.

In step S305, the management apparatus 200 determines whether the stock quantity of the toner containers 301 has become equal to or smaller than the notification threshold value 1704 (FIG. 22). If it is determined in step S305 that the stock quantity of the toner containers 301 has become equal to or smaller than the notification threshold value 1704 (Yes in step S305), then the management apparatus 200 advances to step S306. On the other hand, if it is determined in step S305 that the stock quantity of the toner containers 301 has not become equal to or smaller than the notification threshold value 1704 (No in step S305), then the management apparatus 200 advances to step S309.

In step S306, the management apparatus 200 refers to the notification information database to acquire a subject and a text for a distribution request notification. In step S307, the management apparatus 200 refers to the customer information database and the distributor database to acquire distributor contact information as a notification sending destination.

In step S308, the management apparatus 200 generates a distribution request notification and sends the generated distribution request notification to the distributor. In step S309, the management apparatus 200 ends the processing.

Other Exemplary Embodiments

The present invention can be applied to a system including a plurality of devices (for example, a printer, a facsimile, a PC, or a server apparatus and a client apparatus in a computer system) and to an apparatus that includes only one device.

The present invention can be achieved by directly or remotely supplying a program of software implementing functions of the above-described exemplary embodiments (in the exemplary embodiments, the program corresponding to the processing performed according to the flow charts in the drawings) to a system or an apparatus and reading and executing supplied program of software with the system or a computer of the apparatus.

Accordingly, the program code itself, which is installed to the computer for implementing the functional processing of the present invention, embodies the present invention. The present invention also includes the computer program implementing the functional processing of the present invention.

Accordingly, the program can be configured in any form, such as object code, a program executed by an interpreter, and/or script data supplied to an operating system (OS).

As the recording medium for supplying such program code, a floppy disk, a hard disk, an optical disk, a magneto-optical disk (MO), a compact disk-read only memory (CD-ROM), a CD-recordable (CD-R), a CD-rewritable (CD-RW), a magnetic tape, a nonvolatile memory card, a ROM, and a digital versatile disk (DVD) (a DVD-read only memory (DVD-ROM) and a DVD-recordable (DVD-R)), for example, can be used.

The above program can also be supplied by connecting to a web site on the Internet by using a browser of a client computer and by downloading the program from the web site to a recording medium such as a hard disk. In addition, the above program can also be supplied by downloading a compressed file that includes an automatic installation function from the web site to a recording medium such as a hard disk. The functions of the above embodiments can also be implemented by dividing the program code into a plurality of files and downloading each divided file from different web sites. A World Wide Web (WWW) server for allowing a plurality of users to download the program file for implementing the functional processing constitutes an embodiment of the present invention.

In addition, the above program can also be supplied by distributing a storage medium such as a CD-ROM and the like which stores the program according to the present invention after an encryption thereof; by allowing the user satisfying a prescribed condition to download key information for decoding the encryption from the web site via the Internet; and by executing and installing in the computer the encrypted program code using the key information.

In addition, the functions according to the embodiments described above can be implemented not only by executing the program code read by the computer, but also implemented by the processing in which an OS or the like carries out a part of or the whole of the actual processing based on an instruction given by the program code.

Further, in another aspect of the embodiment of the present invention, after the program code read from the recording medium is written in a memory provided in a function expansion board inserted in a computer or a function expansion unit connected to the computer, a CPU and the like provided in the function expansion board or the function expansion unit carries out a part of or the whole of the processing to implement the functions of the embodiments described above. The present invention may be implemented, for example, as either software instructions, firmware, or both, that are embodied in a medium readable by a machine and that are capable of causing the machine to implement the processing or method of the present invention, for example, as such processing and method are described herein.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A system comprising a management apparatus communicating with an image forming apparatus via a network and the image forming apparatus including a toner supply unit having a stationary toner container and a replaceable toner container, wherein the image forming apparatus comprises:

a fist notification unit configured to notify the management apparatus of a toner-low notification with respect to the stationary toner container; and a second notification unit configured to notify the management apparatus of a replaceability notification with respect to the replaceable toner container when impossibility of toner supply from the replaceable toner container to the stationary toner container is detected, and wherein the management apparatus comprises:

a first receiving unit configured to receive from the image forming apparatus the toner-low notification;

a second receiving unit configured to receive from the image forming apparatus the replaceability notification; and a management unit configured to manage a stock quantity of the replaceable toner containers based on device identification information of the image forming apparatus and at least one of the toner-low notification received by the first receiving unit and the replaceability notification received by the second receiving unit.

2. The system according to claim 1, wherein the management apparatus further comprises a distribution request notification unit configured to issue a distribution request notification for replenishing the stock of the replaceable toner container when the stock quantity managed by the management unit becomes equal to or smaller than a predetermined threshold value.

3. The system according to claim 1, wherein where a maximum number of the replaceable toner containers that can be replaced to replenish a toner to the toner supply unit in a case of a toner-low is N, before the first receiving unit receives a toner-low notification for a first time, the management unit decrements the stock quantity by one every time the second receiving unit receives a replaceability notification and decrements the stock quantity by N when the first receiving unit receives a toner-low notification.

4. The system according to claim 3, wherein in a case where the first receiving unit receives a toner-low notification again after receiving a previous toner-low notification and if a number of replaceability notifications that the second receiving unit receives during a time period between the two toner-low notifications is smaller than (N+1), the management unit decrements the stock quantity by a value equivalent to the number of replaceability notifications received during the time period between the two toner-low notifications.

5. The system according to claim 3, wherein in a case where the number of times the second receiving unit receives the replaceability notifications after the first receiving unit has received the toner-low notification reaches (N+1), the management unit decrements the stock quantity by one every time the second receiving unit receives a replaceability notification until the first receiving unit receives another toner-low notification.

6. A method in system comprising a management apparatus communicating with an image forming apparatus via a network and the image forming apparatus including a toner supply unit having a stationary toner container and a replaceable toner container, the method comprising:

receiving a toner-low notification with respect to the stationary toner container from the image forming apparatus;

receiving a replaceability notification with respect to the replaceable toner container from the image forming apparatus when impossibility of toner supply from the replaceable toner container to the stationary toner container is detected at the image forming apparatus; and managing a stock quantity of the replaceable toner containers based on a device identification information of the image forming apparatus and at least one of the received toner-low notification and the received replaceability notification.

7. The method according to claim 6, further comprising issuing a distribution request notification for replenishing the stock of the replaceable toner container when the managed stock quantity becomes equal to or smaller than a predetermined threshold value.

8. The method according to claim 6, further comprising, where a maximum number of the replaceable toner containers that can be replaced to replenish a toner to the toner supply unit in a case of a toner-low is N, before a toner-low notification is received for a first time, decrementing the stock quantity by one every time a replaceability notification is received and decrementing the stock quantity by N when a toner-low notification is received.

9. The method according to claim 8, further comprising in a case where a toner-low notification is received again after a previous toner-low notification is received and if a number of replaceability notifications that are received during a time period between the two toner-low notifications is smaller than (N+1), decrementing the stock quantity by a value equivalent to the number of replaceability notifications received during the time period between the two toner-low notifications.

10. The method according to claim 8, further comprising in a case where the number of times the replaceability notifications are received after the toner-low notification has been received reaches (N+1), decrementing the stock quantity by one every time a replaceability notification is received until another toner-low notification is received.

* * * * *